US006873239B2

(12) United States Patent
Decristofaro et al.

(10) Patent No.: US 6,873,239 B2
(45) Date of Patent: Mar. 29, 2005

(54) BULK LAMINATED AMORPHOUS METAL INDUCTIVE DEVICE

(75) Inventors: Nicholas J. Decristofaro, Chatham, NJ (US); Gordon E. Fish, Montclair, NJ (US); Ryusuke Hasegawa, Morristown, NJ (US); Carl E. Kroger, Aynor, SC (US); Scott M. Lindquist, Myrtle Beach, SC (US); Seshu V. Tatikola, Bridgewater, NJ (US)

(73) Assignee: Metglas Inc., Conway, SC (US)

( * ) Notice: Subject to any disclaimer, the term of this patent is extended or adjusted under 35 U.S.C. 154(b) by 0 days.

(21) Appl. No.: 10/286,736

(22) Filed: Nov. 1, 2002

(65) Prior Publication Data

US 2004/0085174 A1 May 6, 2004

(51) Int. Cl.[7] ..... H01F 17/06

(52) U.S. Cl. ..... 336/178; 336/90; 336/92; 336/198; 75/123; 148/108

(58) Field of Search ..... 336/178; 335/216, 335/299, 301, 302, 318

(56) References Cited

U.S. PATENT DOCUMENTS

| | | | | |
|---|---|---|---|---|
| 4,219,355 | A | 8/1980 | DeCristofaro et al. | 75/123 |
| 4,226,619 | A | 10/1980 | Hatta et al. | 75/123 |
| 4,298,409 | A | 11/1981 | DeCristofaro et al. | 148/108 |
| 4,437,907 | A | 3/1984 | Sato et al. | 148/31.55 |
| 4,672,346 | A | 6/1987 | Miyamoto et al. | 335/296 |
| 4,734,975 | A | 4/1988 | Ballard et al. | 29/606 |
| 4,766,378 | A | 8/1988 | Danby et al. | 324/307 |
| 4,818,966 | A | 4/1989 | Miyamoto et al. | 335/296 |
| 4,827,235 | A | 5/1989 | Inomata et al. | 335/297 |

(Continued)

FOREIGN PATENT DOCUMENTS

| | | | |
|---|---|---|---|
| EP | A0 060 660 | 9/1982 | C22C/38/02 |
| EP | 0 984 461 A2 | 3/2000 | H01F/7/20 |
| EP | 1 004 888 A1 | 5/2000 | G01R/33/383 |
| EP | 1 004 889 A2 | 5/2000 | G01R/33/383 |
| EP | 1 004 889 A3 | 8/2000 | G01R/33/383 |
| JP | 58-148419 | 9/1983 | H01F/41/02 |
| JP | 59-181504 | 10/1984 | H01F/1/14 |
| JP | 61-131518 | 6/1986 | H01F/41/02 |
| JP | 58-148418 | 9/1993 | H01F/41/02 |

(Continued)

*Primary Examiner*—Lincoln Donovan
*Assistant Examiner*—Jennifer A. Poker

(57) ABSTRACT

A bulk amorphous metal inductive device comprises a magnetic core having at least one low-loss bulk ferromagnetic amorphous metal magnetic component forming a magnetic circuit having an air gap therein. The component comprises a plurality of similarly shaped layers of amorphous metal strips bonded together to form a polyhederally shaped part. The device has one or more electrical windings and is easily customized for specialized magnetic applications, e.g. for use as a transformer or inductor in power conditioning electronic circuitry employing switch-mode circuit topologies and switching frequencies ranging from 1 kHz to 200 kHz or more. The low core losses of the device, e.g. a loss of at most about 12 W/kg when excited at a frequency of 5 kHz to a peak induction level of 0.3 T, make it especially useful at frequencies of 1 kHz or more.

12 Claims, 11 Drawing Sheets

U.S. PATENT DOCUMENTS

| | | | | |
|---|---|---|---|---|
| 4,874,990 | A | 10/1989 | Dobnick | |
| 4,887,059 | A | 12/1989 | Asano et al. | 335/281 |
| 4,892,773 | A | 1/1990 | Chenoweth et al. | 428/121 |
| 5,053,738 | A | 10/1991 | Sato et al. | |
| 5,061,897 | A | 10/1991 | Danby et al. | 324/318 |
| 5,124,651 | A | 6/1992 | Danby et al. | 324/318 |
| 5,134,771 | A | 8/1992 | Lee et al. | 29/609 |
| 5,283,544 | A | 2/1994 | Sakurai et al. | 335/297 |
| 5,495,222 | A | 2/1996 | Abele et al. | 335/306 |
| 5,506,764 | A | 4/1996 | Hon et al. | |
| 5,754,085 | A | 5/1998 | Danby et al. | 335/297 |
| 5,798,680 | A | 8/1998 | Abele et al. | 335/301 |
| 5,935,347 | A | 8/1999 | Suzuki et al. | |
| 5,963,117 | A | 10/1999 | Ohashi et al. | 335/306 |
| 6,014,070 | A | 1/2000 | Danby et al. | 335/296 |
| 6,346,337 | B1 | 2/2002 | DeCristofaro et al. | 428/692 |
| 6,348,275 | B1 | 2/2002 | DeCristofaro et al. | 428/692 |
| 6,420,813 | B1 | 7/2002 | DeCristofaro et al. | 310/216 |
| 6,462,456 | B1 | 10/2002 | DeCristofaro et al. | 310/216 |
| 2001/0043134 | A1 | 11/2001 | DeCristofaro et al. | 335/302 |
| 2002/0074885 | A1 | 6/2002 | DeCristofaro et al. | 310/152 |

FOREIGN PATENT DOCUMENTS

| | | | |
|---|---|---|---|
| WO | WO 94/14994 | 7/1994 | C22C/45/02 |
| WO | WO 95 21044 | 8/1995 | B24C/1/00 |
| WO | WO 95 33596 | 12/1995 | B24C/1/00 |
| WO | WO 96 00449 | 1/1996 | H01F/41/02 |
| WO | WO 99 66624 | 12/1999 | H02K/1/14 |
| WO | WO 00/28556 | 5/2000 | H01F/41/02 |
| WO | WO 00/28640 | 5/2000 | H02K/1/02 |
| WO | WO 01/48889 | 7/2001 | H02K/1/02 |
| WO | WO 01/50483 | 7/2001 | H01F/3/04 |
| WO | WO 01/61825 | 8/2001 | H02K/1/14 |
| WO | WO 01/78088 | 10/2001 | H01F/3/04 |
| WO | WO 01 84564 | 11/2001 | H01F/1/153 |

Section A-A

BULK LAMINATED AMORPHOUS METAL INDUCTIVE DEVICE

BACKGROUND OF THE INVENTION

1. Field of the Invention

This invention relates to an inductive device, and more particularly, to a high efficiency, low core loss inductive device having a core comprising one or more bulk amorphous metal magnetic components.

2. Description of the Prior Art

Inductive devices are essential components of a wide variety of modern electrical and electronic equipment, most commonly including transformers and inductors. Most of these devices employ a core comprising a soft ferromagnetic material and one or more electrical windings that encircle the core. Inductors generally employ a single winding with two terminals, and serve as filters and energy storage devices. Transformers generally have two or more windings. They transform voltages from one level to at least one other desired level, and electrically isolate different portions of an overall electric circuit. Inductive devices are available in widely varying sizes with correspondingly varying power capacities. Different types of inductive devices are optimized for operation at frequencies over a very wide range, from DC to GHz. Virtually every known type of soft magnetic material finds application in the construction of inductive devices. Selection of a particular soft magnetic material depends on the combination of properties needed, the availability of the material in a form that lends itself to efficient manufacture, and the volume and cost required to serve a given market. In general, a desirable soft ferromagnetic core material has high saturation induction $B_{sat}$ to minimize core size, and low coercivity $H_c$, high magnetic permeability $\mu$, and low core loss to maximize efficiency.

Components such as motors and small to moderate size inductors and transformers for electrical and electronic devices often are constructed using laminations punched from various grades of magnetic steel supplied in sheets having thickness as low as 100 $\mu$m. The laminations are generally stacked and secured and subsequently wound with the requisite one or more electrical windings that typically comprise high conductivity copper or aluminum wire. These laminations are commonly employed in cores with a variety of known shapes.

Many of the shapes used for inductors and transformers are assembled from constituent components which have the general form of certain block letters, such as "C," "U," "E," and "I", by which the components are often identified. The assembled shape may further be denoted by the letters reflecting the constituent components; for example, an "E-I" shape would be made by assembling an "E" component with an "I" component. Other widely used assembled shapes include "E-E," "C-I," and "C-C." Constituent components for prior art cores of these shapes have been constructed both of laminated sheets of conventional crystalline ferromagnetic metal and of machined bulk soft ferrite blocks.

Although many amorphous metals offer superior magnetic performance when compared to other common soft ferromagnetic materials, certain of their physical properties make conventional fabrication techniques difficult or impossible. Amorphous metal is typically supplied as a thin, continuous ribbon having a uniform ribbon width. However, amorphous metals are thinner and harder than virtually all conventional metallic soft magnetic alloys, so conventional stamping or punching of laminations causes excessive wear on fabrication tools and dies, leading to rapid failure. The resulting increase in the tooling and manufacturing costs makes fabricating bulk amorphous metal magnetic components using such conventional techniques commercially impractical. The thinness of amorphous metals also translates into an increased number of laminations needed to form a component with a given cross-section and thickness, further increasing the total cost of an amorphous metal magnetic component. Machining techniques used for shaping ferrite blocks are also not generally suited for processing amorphous metals.

The properties of amorphous metal are often optimized by an annealing treatment. However, the annealing generally renders the amorphous metal very brittle, further complicating conventional manufacturing processes. As a result of the aforementioned difficulties, techniques that are widely and readily used to form shaped laminations of silicon steel and other similar metallic sheet-form FeNi- and FeCo-based crystalline materials, have not been found suitable for manufacturing amorphous metal devices and components. Amorphous metals thus have not been accepted in the marketplace for many devices; this is so, notwithstanding the great potential for improvements in size, weight, and energy efficiency that in principle would be realized from the use of a high induction, low loss material.

For electronic applications such as saturable reactors and some chokes, amorphous metal has been employed in the form of spirally wound, round toroidal cores. Devices in this form are available commercially with diameters typically ranging from a few millimeters to a few centimeters and are commonly used in switch-mode power supplies providing up to several hundred volt-amperes (VA). This core configuration affords a completely closed magnetic circuit, with negligible demagnetizing factor. However, in order to achieve a desired energy storage capability, many inductors require a magnetic circuit that includes a discrete air gap. The presence of the gap results in a non-negligible demagnetizing factor and an associated shape anisotropy that are manifested in a sheared magnetization (B-H) loop. The shape anisotropy may be much higher than the possible induced magnetic anisotropy, increasing the energy storage capacity proportionately. Toroidal cores with discrete air gaps and conventional material have been proposed for such energy storage applications.

However, the stresses inherent in a strip-wound toroidal core give rise to certain problems. The winding inherently places the outside surface of the strip in tension and the inside in compression. Additional stress is contributed by the linear tension needed to insure smooth winding. As a consequence of magnetostriction, a wound toroid typically exhibits magnetic properties that are inferior to those of the same strip measured in a flat strip configuration. Annealing in general is able to relieve only a portion of the stress, so only a part of the degradation is eliminated. In addition, gapping a wound toroid frequently causes additional problems. Any residual hoop stress in the wound structure is at least partially removed on gapping. In practice the net hoop stress is not predictable and may be either compressive or tensile. Therefore the actual gap tends to close or open in the respective cases by an unpredictable amount as required to establish a new stress equilibrium. Therefore, the final gap is generally different from the intended gap, absent corrective measures. Since the magnetic reluctance of the core is determined largely by the gap, the magnetic properties of finished cores are often difficult to reproduce on a consistent basis in the course of high-volume production.

Furthermore, designers frequently seek flexibility not afforded by a limited selection of standard gapped toroidal core structures. For these applications, it is desirable for a user to be able to adjust the gap so as to select a desired degree of shearing and energy storage. In addition, the equipment needed to apply windings to a toroidal core is more complicated, expensive, and difficult to operate than comparable winding equipment for laminated cores. Oftentimes a core of toroidal geometry cannot be used in a high current application, because the heavy gage wire dictated by the rated current cannot be bent to the extent needed in the winding of a toroid. In addition, toroidal designs have only a single magnetic circuit. As a result, they are generally best suited for single phase applications. Other configurations more amenable to easy manufacture and application, while still affording attractive magnetic properties and efficiency, especially for polyphase (including three phase) requirements, are thus sought.

Amorphous metals have also been used in transformers for much higher power devices, such as distribution transformers for the electric power grid that have nameplate ratings of 10 kVA to 1 MVA or more. The cores for these transformers are often formed in a step-lap wound, generally rectangular configuration. In one common construction method, the rectangular core is first formed and annealed. The core is then unlaced to allow pre-formed windings to be slipped over the long legs of the core. Following the incorporation of the pre-formed windings, the layers are relaced and secured. A typical process for constructing a distribution transformer in this manner is set forth in U.S. Pat. No. 4,734,975 to Ballard et al. Such a process understandably entails significant manual labor and manipulation steps involving brittle annealed amorphous metal ribbons. These steps are especially tedious and difficult to accomplish with cores smaller than 10 kVA. Furthermore, in this configuration, the cores are not readily susceptible to controllable introduction of an air gap, which is needed for many inductor applications.

Another difficulty associated with the use of ferromagnetic amorphous metals arises from the phenomenon of magnetostriction. Certain magnetic properties of any magnetostrictive material change in response to imposed mechanical stress. For example, the magnetic permeability of a component containing amorphous materials typically is reduced, and its core losses are increased, when the component is subjected to stress. The degradation of soft magnetic properties of the amorphous metal device due to the magnetostriction phenomenon may be caused by stresses resulting from any combination of sources, including deformation during core fabrication, mechanical stresses resulting from mechanical clamping or otherwise fixing the amorphous metal in place and internal stresses caused by the thermal expansion and/or expansion due to magnetic saturation of the amorphous metal material. As an amorphous metal magnetic device is stressed, the efficiency at which it directs or focuses magnetic flux is reduced, resulting in higher magnetic losses, reduced efficiency, increased heat production, and reduced power. The extent of this degradation is oftentimes considerable. It depends upon the particular amorphous metal material and the actual intensity of the stresses, as indicated by U.S. Pat. No. 5,731,649.

Amorphous metals have far lower anisotropy energies than many other conventional soft magnetic materials, including common electrical steels. Stress levels that would not have a deleterious effect on the magnetic properties of these conventional metals have a severe impact on magnetic properties such as permeability and core loss, which are important for inductive components. For example, the '649 patent teaches that forming amorphous metal cores by rolling amorphous metal into a coil, with lamination using an epoxy, detrimentally restricts the thermal and magnetic saturation expansion of the coil of material. High internal stresses and magnetostriction are thereby produced, which reduce the efficiency of a motor or generator incorporating such a core. In order to avoid stress-induced degradation of magnetic properties, the '649 patent discloses a magnetic component comprising a plurality of stacked or coiled sections of amorphous metal carefully mounted or contained in a dielectric enclosure without the use of adhesive bonding.

A significant trend in recent technology has been the design of power supplies, converters, and related circuits using switch-mode circuit topologies. The increased capabilities of available power semiconductor switching devices have allowed switch-mode devices to operate at increasingly high frequencies. Many devices that formerly were designed with linear regulation and operation at line frequencies (generally 50–60 Hz on the power grid or 400 Hz in military applications) are now based on switch-mode regulation at frequencies that are often 5–200 kHz, and sometimes as much as 1 MHz. A principal driving force for the increase in frequency is the concomitant reduction in the size of the required magnetic components, such as transformers and inductors. However, the increase in frequency also markedly increases the magnetic losses of these components. Thus there exists a significant need to lower these losses.

The limitations of magnetic components made using existing materials entail substantial and undesirable design compromises. In many applications, the core losses of the common electrical steels are prohibitive. In such cases a designer may be forced to use a permalloy alloy or a ferrite as an alternative. However, the attendant reduction in saturation induction (e.g. 0.6–0.9 T or less for various permalloy alloys and 0.3–0.4 T for ferrites, versus 1.8–2.0 T for ordinary electrical steels) necessitates an increase in the size of the resulting magnetic components. Furthermore, the desirable soft magnetic properties of the permalloys are adversely and irreversibly affected by plastic deformation which can occur at relatively low stress levels. Such stresses may occur either during manufacture or operation of the permalloy component. While soft ferrites often have attractively low losses, their low induction values result in impractically large devices for many applications wherein space is an important consideration. Moreover, the increased size of the core undesirably necessitates a longer electrical winding, so ohmic losses increase.

Notwithstanding the advances represented by the above disclosures, there remains a need in the art for improved inductive devices that exhibit a combination of excellent magnetic and physical properties needed for current requirements. Construction methods are also sought that use amorphous metal efficiently and can be implemented for high volume production of devices of various types.

SUMMARY OF THE INVENTION

The present invention provides a high efficiency inductive device including a magnetic core that has a magnetic circuit with at least one air gap. The core comprises at least one low-loss bulk amorphous metal magnetic component and one or more electrical windings. The component is polyhedrally shaped and comprises a plurality of substantially similarly shaped, planar layers of amorphous metal strips that are stacked, registered, and bonded together with an adhesive agent. Advantageously, the device has a low core loss, e.g. a core loss of less than about 12 W/kg when operated at an excitation frequency "f" of 5 kHz to a peak induction level "$B_{max}$" of 0.3 T. In another aspect, the device has a core loss less than "L" wherein L is given by the formula $L=0.0074\ f(B_{max})^{1.3}+0.000282\ f^{1.5}\ (B_{max})^{2.4}$, the core loss, excitation frequency, and peak induction level being measured in watts per kilogram, hertz, and teslas, respectively.

The invention further provides a method for constructing a low core loss, bulk amorphous metal magnetic component, comprising the steps of: (i) cutting amorphous metal strip material to form a plurality of planar laminations, each having a substantially identical, pre-determined shape; (ii) stacking and registering the laminations to form a lamination stack having a three-dimensional shape; (iii) annealing the laminations to improve the magnetic properties of the component; and (iv) adhesively bonding the lamination stack with an adhesive agent. The steps for constructing the component may be carried out in a variety of orders, as described hereinbelow in greater detail. The cutting of the laminations is carried out using a variety of techniques. Preferably, a stamping operation comprising use of high hardness die sets and high strain-rate punching is used. For embodiments employing relatively small lamination sizes, photolithographic etching is preferably used for the cutting. The bonding of the component is preferably accomplished by an impregnation process in which a low viscosity, thermally activated epoxy is allowed to infiltrate the spaces between layers in the lamination stack.

In some embodiments the magnetic core has a single bulk magnetic component, while in others, a plurality of components are assembled in juxtaposed relationship to form the magnetic core. The plural components are secured in position by a securing means. The inductive device further comprises at least one electrical winding encircling at least a portion of the magnetic core. Each of the components comprises a plurality of substantially similarly shaped, planar layers of amorphous metal strips bonded together with an adhesive agent to form a generally polyhedrally shaped part having a plurality of mating faces. The thickness of each component is substantially equal. The components are assembled with the layers of amorphous metal in each component being in substantially parallel planes and with each mating face being proximate a mating face of another component of the device. Advantageously processes of forming the bulk amorphous metal magnetic component and assembling the magnetic core are accomplished without introducing stress to a level that unacceptably degrades soft magnetic properties such as permeability and core loss.

The inductive device of the invention finds use in a variety of circuit applications, and may serve, e.g., as a transformer, autotransformer, saturable reactor, or inductor. The component is especially useful in the construction of power conditioning electronic devices that employ various switch mode circuit topologies. The device is useful in both single and polyphase applications, and especially in three-phase applications.

Advantageously the bulk amorphous metal magnetic components are readily assembled to form the one or more magnetic circuits of the finished inductive device. In some aspects, the mating faces of the components are brought into intimate contact to produce a device having low reluctance and a relatively square B-H loop. However, by assembling the device with air gaps interposed between the mating faces, the reluctance is increased, providing a device with enhanced energy storage capacity useful in many inductor applications. The air gaps are optionally filled with non-magnetic spacers. It is a further advantage that a limited number of standardized sizes and shapes of components may be assembled in a number of different ways to provide devices with a wide range of electrical characteristics.

In some embodiments of the present invention, the components used in constructing the present device have shapes generally similar to those of certain block letters such as "C," "U," "E," and "I" by which they are identified. Each of the components has at least two mating faces that are brought proximate and parallel to a like number of complementary mating faces on other components. Devices employing these components are often denoted by the letters of the two or more constituent components. For example, "C-I," "E-I," "E-E," "C-C", and "C-I-C" devices are conveniently formed with the components of the invention. In some aspects of the invention, components having mitered mating faces are advantageously employed. The flexibility of size and shape of the components permits a designer wide latitude in suitably optimizing both the overall core and the one or more winding windows therein. As a result, the overall size of the device is minimized, along with the volume of both core and winding materials required. The combination of flexible device design and the high saturation induction of the core material are beneficial in designing electronic circuit devices having compact size and high efficiency. Compared to prior art inductive devices using lower saturation induction core material, transformers and inductors of given power and energy storage ratings generally are smaller and more efficient. As a result of its very low core losses under periodic magnetic excitation, the magnetic device of the invention is operable at frequencies ranging from DC to as much as 200 kHz or more. It exhibits improved performance characteristics when compared to conventional silicon-steel magnetic devices operated over the same frequency range. These and other desirable attributes render the present device easily customized for specialized magnetic applications, e.g. for use as a transformer or inductor in power conditioning electronic circuitry employing switch-mode circuit topologies and switching frequencies ranging from 1 kHz to 200 kHz or more.

The present device is readily provided with one or more electrical windings. In some embodiments, the windings are wound directly onto one or more of the components. The windings for devices having plural bulk magnetic components are advantageously formed in a separate operation, either in a self-supporting assembly or wound onto a bobbin coil form, and slid onto one or more of the components. The difficulty and complication of providing windings on prior art toroidal magnetic cores is thereby eliminated.

The present invention also provides a method for constructing a highly efficient inductive device incorporating a plurality of bulk amorphous metal magnetic components. An implementation of the method includes the steps of: (i) encircling at least one of the magnetic components with an electrical winding; (ii) positioning said components in juxtaposed relationship to form said core having at least one magnetic circuit, the layers of each component lying in substantially parallel planes; and (iii) securing the components in the juxtaposed relationship. The assembly of the device advantageously does not impart excessive stress that would unacceptably degrade the soft magnetic properties of the components and the device in which they are incorporated.

BRIEF DESCRIPTION OF THE DRAWINGS

The invention will be more fully understood and further advantages will become apparent when reference is had to the following detailed description of the preferred embodiments of the invention and the accompanying drawings, wherein like reference numerals denote similar elements throughout the several views, and in which.

DETAILED DESCRIPTION OF THE INVENTION

The present invention is directed to high efficiency inductive devices such as inductors and transformers. The devices employ a magnetic core comprising one or more low-loss bulk ferromagnetic amorphous metal components that form at least one magnetic circuit. Generally polyhedrally shaped bulk amorphous metal components constructed in accordance with the present invention can have various geometrical shapes, including rectangular, square, and trapezoidal prisms, and the like. In addition, any of the previously mentioned geometric shapes may include at least one arcuate surface, and preferably two oppositely disposed arcuate surfaces, to form a generally curved or arcuate bulk amorphous metal component. The inductive device further comprises at least one electrically conductive winding.

Figure 1A:
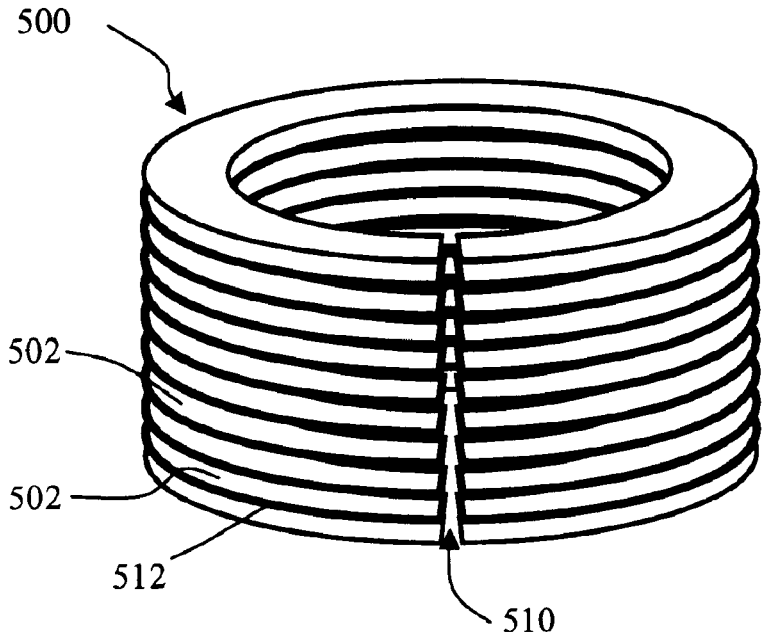
FIG. 1A is a perspective view depicting a gapped, toroidal core used in constructing the inductive device of the invention.
Figure 1B:
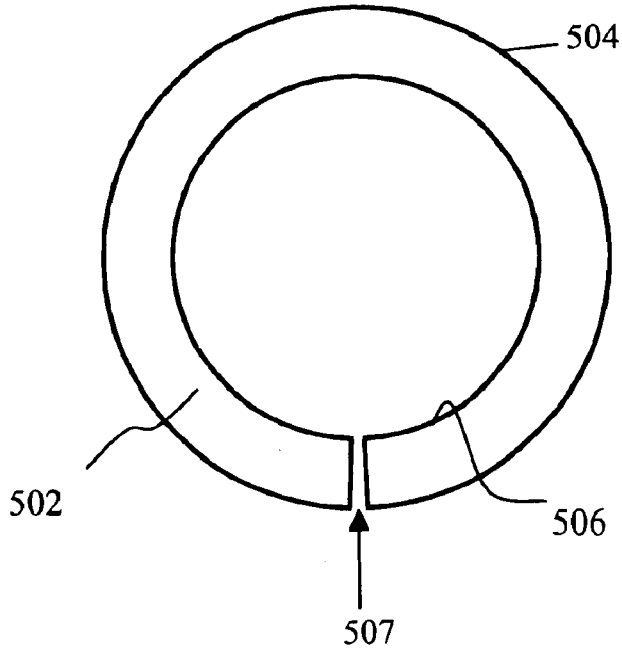
FIG. 1B is a plan view depicting a lamination cut from amorphous metal strip material for incorporation in a gapped toroidal core comprised in an inductive device of the invention.

In one aspect of the invention, the device comprises a magnetic core having a single bulk amorphous metal component comprised of a plurality of planar layers that are cut from amorphous metal strip and have substantially similar shape. The layers are stacked, registered, and bonded with an adhesive agent. Each of the layers has an air gap, with the gaps being aligned in the laminated component to form an overall air gap. Referring now to FIGS. 1A and 1B there is depicted generally a core 500 used in constructing one form of the inductive device of the invention. Core 500 comprises a single bulk amorphous metal magnetic component having the shape of a toroid with an included air gap 510. A plurality of layers 502, best visualized in FIG. 1B, are cut in generally annular shape having an outside edge 504 and an inside edge 506. A slot 507 extending from outside edge 504 to inside edge 506 is formed in each layer 502. The width of slot 507 is selected so a suitable demagnetizing factor is attained in finished core 500. Core 500 is formed of a plurality of layers 502 that are stacked and registered. That is to say, layers 502 are positioned so that their respective inside and outside edges 506, 504 and slots 507 are generally aligned to form smooth, generally cylindrical inside and outside surfaces. Such registration may be carried out as each layer 502 is sequentially added to the stack. Alternatively, the layers may be aligned as a group after completion of stacking. The aligned slots collectively form air gap 510 in which a spacer (not depicted) is optionally inserted. The layers 502 are bonded by an adhesive agent, preferably by impregnation with a low viscosity epoxy 512. In the aspect depicted, the layers are circular annuli, but other non-circular shapes are also possible, for example oval, racetrack, and square and rectangular picture frame-like shapes of any aspect ratio. The inside or outside vertices of the layers in any of the embodiments are optionally radiused. Slot 507 is shown as being radially directed, but it may also be formed in any orientation that extends from the inside to the outside edge. In addition, slot 507 may be formed in a generally rectangular shape as depicted, or it may be tapered or contoured to achieve other desired effects on the B-H loop of the core. The construction of the inductive device of the invention further includes provision of at least one toroidal winding (not shown) on the core.

Layers 502 in the requisite shape may be fabricated by any method, including, non-exclusively, photolithographic etching or punching of amorphous metal ribbon or strip. A photolithographic etching process is especially preferred for fabricating small parts, since it is relatively easily automated and affords tight, reproducible dimensional control of the finished layers. Such control, in turn, allows large-scale production of cores comprising uniformly sized laminations and thereby having well-defined and uniform magnetic properties. The present fabrication methods afford a further advantage over tape-wound core structures, in that compressive and tensile stresses that result inherently from bending strip into a spiral structure are absent in a flat lamination. Any stress resulting from cutting, punching, etching, or the like, will likely be confined merely to a small region at or near the periphery of an individual lamination.

In another aspect of the invention, similar fabrication processes are used to form layers that are incorporated in bulk amorphous metal magnetic components that may have overall shapes generally similar to those of certain block letters such as "C," "U," "E," and "I" by which they are identified. Each of the components comprises a plurality of planar layers of amorphous metal. The layers are stacked to substantially the same height and packing density, registered, and bonded together to form the components for the inductive device of the invention.

Multiple-component embodiments of the present device are assembled by securing the components in adjacent relationship with a securing means, thereby forming at least one magnetic circuit. In the assembled configuration the layers of amorphous metal strip in all of the components lie in substantially parallel planes. Each of the components has at least two mating faces that are brought proximate and parallel to a like number of complementary mating faces on other components. Some of the shapes, e.g. C, U, and E shapes, terminate in mating faces that are generally substantially co-planar. The I (or rectangular prismatic) shape may have two parallel mating faces at its opposite ends or one or more mating faces on its long sides, or both. Preferably the mating faces are substantially perpendicular to the planes of the constituent ribbons in the component to minimize core loss. Some embodiments of the invention further comprise bulk magnetic components having mating faces that are mitered relative to the elongated direction of features of the component.

In some embodiments of the invention two magnetic components, each having two mating faces, are used when forming the inductive device with a single magnetic circuit. In other aspects the components have more than two mating faces or the devices have more than two components; accordingly, some of these embodiments also provide more than one magnetic circuit. As used herein, the term magnetic circuit denotes a path along which continuous lines of magnetic flux are caused to flow by imposition of a magnetomotive force generated by a current-carrying winding encircling at least a part of the magnetic circuit. A closed magnetic circuit is one in which flux lies exclusively within a core of magnetic material, while in an open circuit part of the flux path lies outside the core material, for example traversing an air gap or a non-magnetic spacer between portions of the core. The magnetic circuit of the device of the invention is preferably relatively closed, the flux path lying predominantly within the magnetic layers of the components of the device but also crossing at least two air gaps between the proximate mating faces of the respective components. The openness of the circuit may be specified by the fraction of the total magnetic reluctance contributed by the air gaps and by the magnetically permeable core material. Preferably, the magnetic circuit of the present device has a reluctance to which the gap contribution is at most ten times that of the permeable components.

Figure 2:
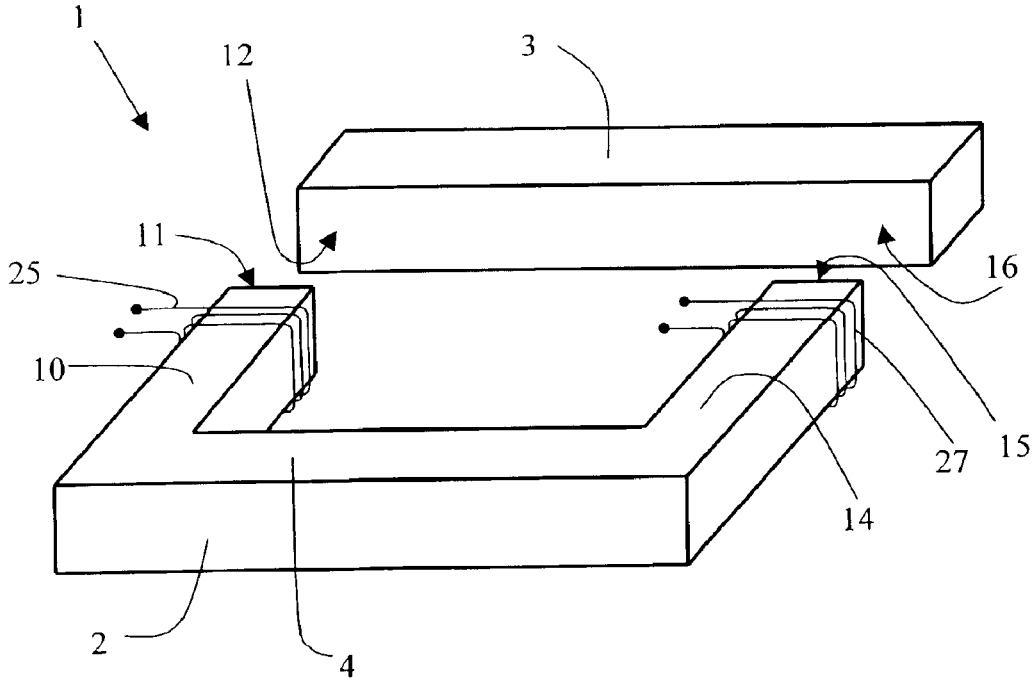
FIG. 2 is a perspective view depicting an inductive device of the invention having a "C-I" shape assembled using bulk amorphous metal magnetic components having "C" and "I" shapes.

Referring in detail to FIG. 2, there is depicted generally one form of a "C-I" shaped inductive device 1 of the invention comprising a "C"-shaped magnetic component 2 and an "I"-shaped magnetic component 3. "C" component 2 further includes first side leg 10 and second side leg 14, each extending perpendicularly from a common side of back portion 4 and terminating distally in a first rectangular mating face 11 and a second rectangular mating face 15, respectively. The mating faces are generally substantially coplanar. Side legs 10, 14 depend from opposite ends of the side of back portion 4. "I" component 3 is a rectangular prism having a first rectangular mating face 12 and a second rectangular mating face 16, both of which are located on a common side of component 3. The mating faces 12, 16 have a size and spacing therebetween complementary to that of the respective mating faces 11, 15 at the ends of legs 10, 14 of component 2. Each of the side legs 10, 14, back portion 4 between the side legs, and I component 3 has a generally rectangular geometric cross-section, all of which preferably have substantially the same height, width, and effective magnetic area. By effective magnetic area is meant the area within the geometric cross-section occupied by magnetic material, which is equal to the total geometric area times the lamination fraction.

Figure 3A:
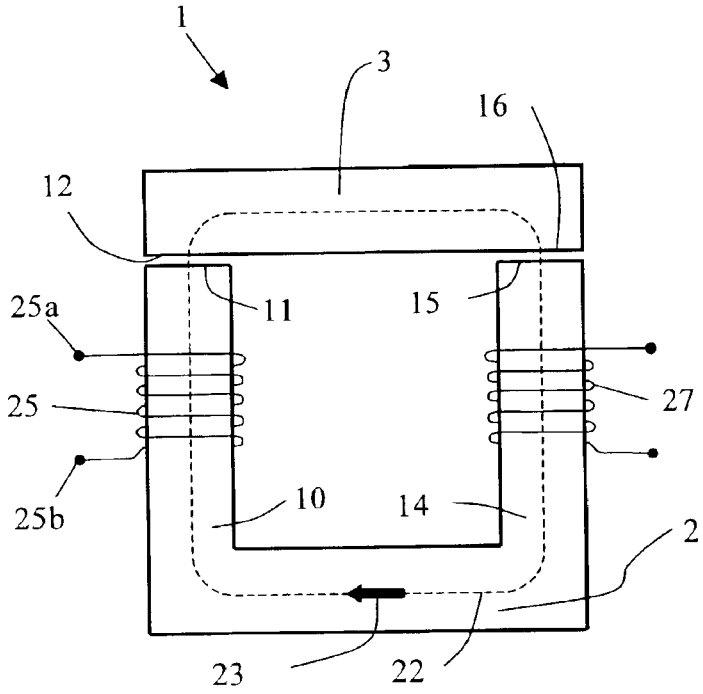
FIG. 3A is a plan view depicting an inductive device of the invention having a "C-I" shape wherein the "C" and "I" shaped bulk amorphous metal magnetic components are in mating contact and the C-shaped component bears an electrical winding on each of its legs.

In one aspect of the invention best visualized in FIG. 3A, the complementary mating faces 11, 12 and 15, 16, respectively, are brought into intimate contact during assembly of the C-I device 1. This disposition provides a low reluctance for device 1 and concomitantly a relatively square B-H magnetization loop. In another aspect, seen in FIG. 3B, optional spacers 13, 17 are interposed between the respective mating faces of components 2, 3 to provide gaps between the components in the magnetic circuit, the gaps also being known as air gaps. Spacers 13, 17 preferably are composed of a non-conductive, non-magnetic material having sufficient heat resistance to prevent degradation or deformation upon exposure to the temperatures encountered in the assembly and operation of device 1. Suitable spacer materials include ceramics and polymeric and plastic materials such as polyimide film and kraft paper. The width of the gap is preferably set by the thickness of spacers 13, 17 and is selected to achieve a desired reluctance and demagnetizing factor, which, in turn, determine the associated degree of shearing of the B-H loop of device 1 needed for application in a given electrical circuit.

Figure 3B:
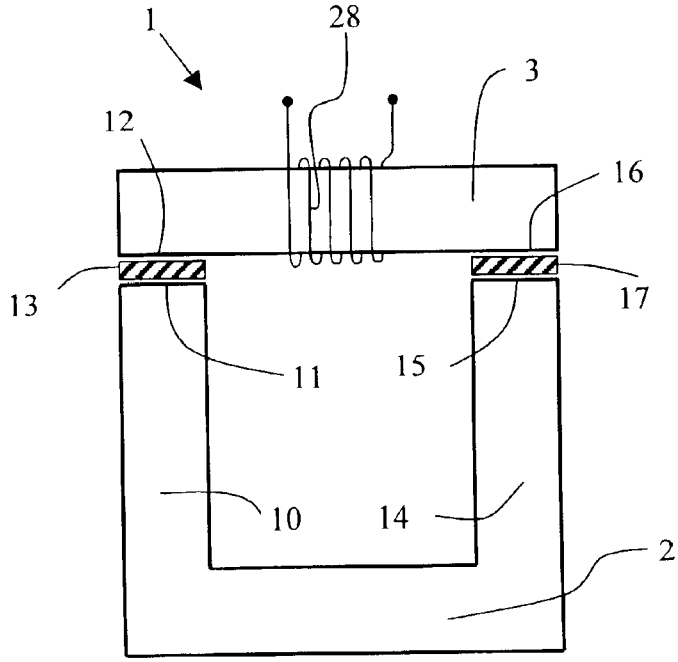
FIG. 3B is a plan view illustrating an inductive device of the invention having a "C-I" shape wherein the "C" and "I" shaped bulk amorphous metal magnetic components are separated by spacers and the I-shaped component bears an electrical winding.

The "C-I" device 1 further comprises at least one electrical winding. In the aspect depicted by FIGS. 2 and 3A there are provided a first electrical winding 25 and a second electrical winding 27 encircling the respective legs 10, 14. A current passing in the positive sense, entering at terminal 25*a* and exiting at terminal 25*b*, urges a flux generally along a path 22 and having the indicated sense 23 in accordance with the right-hand rule. C-I device 1 may be operated as an inductor using either one of windings 25, 27 or with both connected in series aiding to increase inductance. Alternatively C-I device 1 may be operated as a transformer, e.g. with winding 25 connected as the primary and winding 27 connected as the secondary, in a manner well known in the art of electrical transformers. The number of turns in each winding is selected in accordance with known principles of transformer or inductor design. FIG. 3B further depicts an alternative inductor configuration having a single winding 28 disposed on I component 3.

Figure 4:
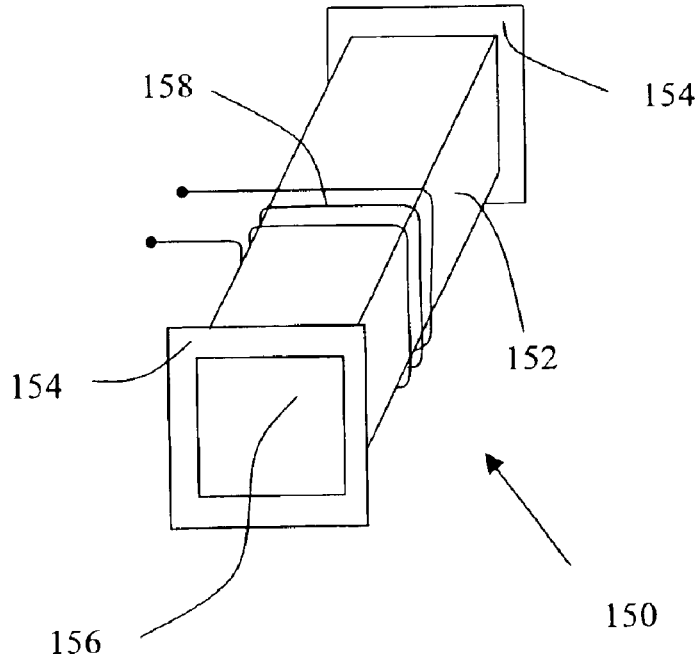
FIG. 4 is a perspective view illustrating a bobbin bearing electrical windings and adapted to be placed on a bulk amorphous metal magnetic component comprised in the inductive device of the invention.

The at least one electrical winding of device 1 may be located at any place on either of the components 2, 3 although the windings preferably do not impinge on any of the air gaps. One convenient means of providing the winding is to wind turns of conductive wire, usually copper or aluminum, onto a bobbin having a hollow interior volume dimensioned to allow it to be slipped over one of legs 10, 14 or onto I component 3. FIG. 4 depicts one form of bobbin 150 having a body section 152, end flanges 154, and an interior aperture 156 dimensioned to permit bobbin 150 to be slipped over the requisite magnetic component. One or more windings 158 encircle body section 152. Advantageously, wire may be wound on bobbin 150 in a separate operation using simple winding equipment, prior to assembly of the inductive device. Bobbin 150, preferably composed of a non-conductive plastic such as polyethylene terephthalate resin, provides added electrical insulation between the windings and the core. Furthermore, the bobbin affords mechanical protection for the core and windings during fabrication and use of the device. Alternatively turns of wire may be wound directly over a portion of one of the components 2, 3. Any known form of wire, including round, rectangular, and tape forms, may be used.

The assembly of C-I device 1 is secured to provide mechanical integrity to the finished device and to maintain the relative positioning of the constituent components 2, 3, the electrical windings 25, 27, the gap spacers 13, 17 if present, and ancillary hardware. The securing may comprise any combination of mechanical banding, clamping, adhesives, potting, or the like. Device 1 may further comprise an insulative coating on at least a portion of the external surfaces of the components 2, 3. Such a coating preferably is not present on any of mating surfaces 11, 12, 15, 16 in aspects wherein the lowest possible reluctance and intimate contact of the components is desired. The coating is especially helpful if windings are applied directly to components 2, 3, since abrasion, shorting, or other damage to the insulation of the wire windings may otherwise occur. The coating may comprise epoxy resins, or paper- or polymer-backed tape, or other known insulative materials wound around the surface of either component.

Figure 3C:
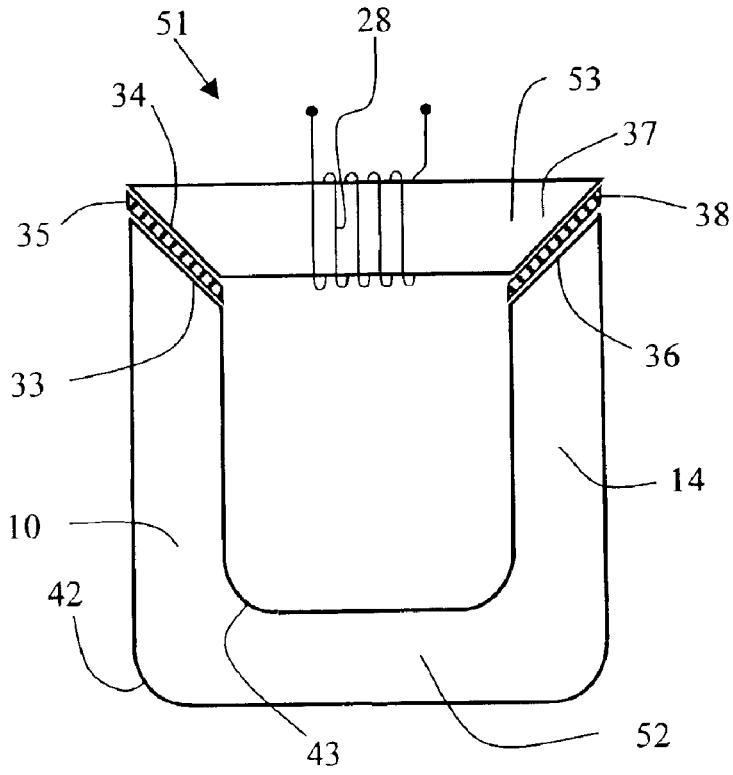
FIG. 3C is a plan view showing an inductive device of the invention that has a "C-I" shape and comprises bulk amorphous metal magnetic components that have mitered mating faces.

Another implementation of a C-I core of the invention is depicted by FIG. 3C. In this aspect, core 51 comprises C-shaped component 52 and trapezoidal component 53. The distal ends of legs 10, 14 of C-component 52 are mitered at an inwardly sloping angle, preferably 45°, and terminate in mitered mating faces 33, 36. C-component 52 also has radiused outside and inside vertices 42, 43 at each of its corners. Such radiused vertices may be present in many components used in the implementation of this invention. Trapezoidal component 53 terminates in mitered mating faces 34, 37. The mitering of component 53 is at an angle complementary to that of C-component 52, and is preferably also 45°. With this arrangement of the miter angles, component 52, 53 can be juxtaposed so that their respective mating faces either make intimate contact, or as depicted by FIG. 2C, are slightly separated to form an air gap in which spacers 35, 38 are optionally interposed.

Figure 5:
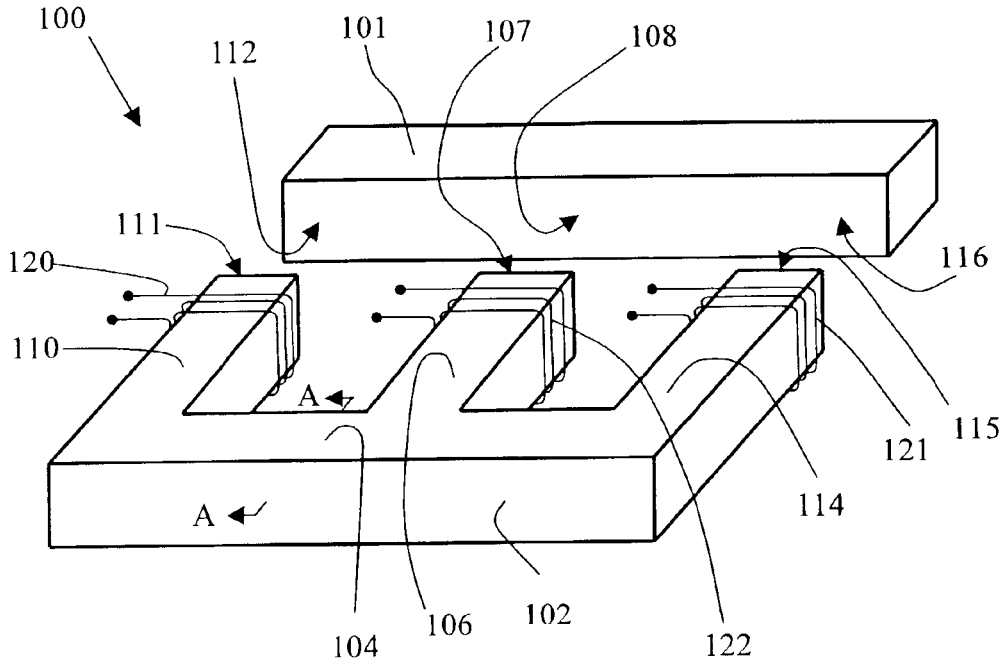
FIG. 5 is a perspective view depicting an inductive device of the invention having an "E-I" shape assembled using bulk amorphous metal magnetic components having "E" and "I" shapes and a winding disposed on each of the legs of the "E" shape.
Figure 6:
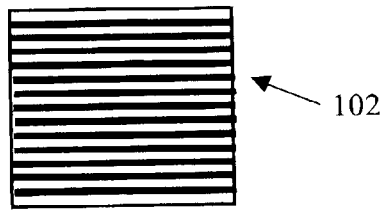
FIG. 6 is a cross-section view illustrating a portion of the device shown by FIG. 5.
Figure 7:
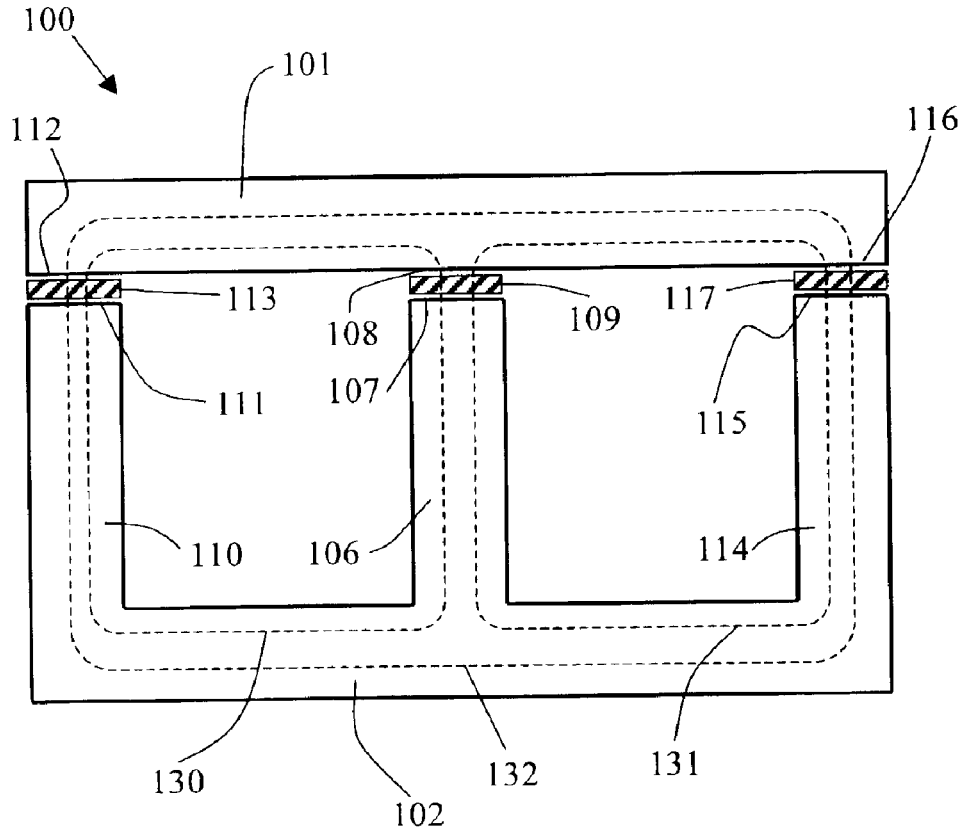
FIG. 7 is a plan view showing an "E-I" shaped inductive device of the invention comprising "E" and "I" shaped bulk amorphous metal magnetic components assembled with air gaps and spacers between the mating faces of the respective components.

FIGS. 5–7 depict aspects of the invention that provide an "E-I" device 100 including constituent components having "E" and "I" shapes. E component 102 comprises a plurality of layers prepared from ferromagnetic metal strip. Each layer has a substantially identical E-shape. The layers are bonded together to form E component 102 substantially uniform in thickness and having a back portion 104 and a central leg 106, a first side leg 110, and a second side leg 114. Each of central leg 106 and side legs 110, 114 extends perpendicularly from a common side of back portion 104 and terminates distally in a rectangular face 107, 111, and 115, respectively. Central leg 106 depends from the center of back portion 104, while side legs 110, 114 depend respectively from opposite ends of the same side of back portion 104. The lengths of central leg 106 and side legs 110, 114 are generally substantially identical so that the respective faces 107, 111, 115 are substantially co-planar. As depicted by FIG. 6, the cross-section A—A of the back portion 104 between central leg 104 and either of side legs 110, 114 is substantially rectangular with a thickness defined by the height of the stacked layers and a width defined by the width of each layer. Preferably the width of back-portion 104 in cross-section A—A is chosen to be at least as wide as any of the faces 107, 111, 115.

I component 101 has a rectangular prismatic shape and comprises a plurality of layers prepared using the same ferromagnetic metal strip as the layers in E component 102. The layers are bonded together to form I component 101 with a substantially uniform thickness. I component 101 has a thickness and a width which are substantially equal to the thickness and width of back portion 104 at section A—A and a length substantially identical to the length of E component 102 measured between the outside surfaces of the side legs 110, 114. On one side of I component 101 at its center is provided a central mating face 108, while a first end mating face 112 and a second end mating face 116 are located at opposite ends of the same side of component 101. Each of mating faces 107, 111, and 115 is substantially identical in size to the complementary faces 108, 112, and 116, respectively.

As further depicted by FIGS. 5 and 7, the assembly of device 100 comprises: (i) providing one or more electrical windings, such as windings 120, 121, and 122, encircling one or more portions of components 102 or 101; (ii) aligning E component 102 and I component 101 in close proximity and with all the layers therein being in substantially parallel planes; and (iii) mechanically securing components 101 and 102 in juxtaposed relationship. Components 102 and 101 are aligned such that faces 107 and 108, 111 and 112, and 115 and 116, respectively, are in proximity. The spaces between the respective faces define three air gaps with substantially identical thickness. Spacers 109, 113, and 117 are optionally placed in these gaps to increase the reluctance and the energy storage capacity of each of the magnetic circuits in device 100. Alternatively, the respective faces may be brought into intimate mating contact to minimize the air gaps and increase the initial inductance.

The "E-I" device 100 may be incorporated in a single phase transformer having a primary winding and a secondary winding. In one such implementation winding 122 serves as the primary and windings 120 and 121 connected in series-aiding serve as the secondary. In this implementation it is preferred that the width of each of side legs 110 and 114 be at least half the width of center leg 106.

The implementations in FIGS. 5–7 provide three magnetic circuits schematically having paths 130, 131, and 132 in "E-I" device 100. As a result, device 100 may be used as a three-phase inductor, with each of the three legs bearing a winding for one of the three phases. In still another implementation "E-I" device 100 may be used as a three-phase transformer, with each leg bearing both the primary and secondary windings for one of the phases. In most implementations of an E-I device intended for use in a three-phase circuit it is preferred that the legs 106, 110, and 114 be of equal width to balance the three phases better. In certain specialized designs, the different legs may have different cross-sections, different gaps, or different numbers of turns. Other forms suitable for various polyphase applications will be apparent to those having ordinary skill in the art.

Figure 8:
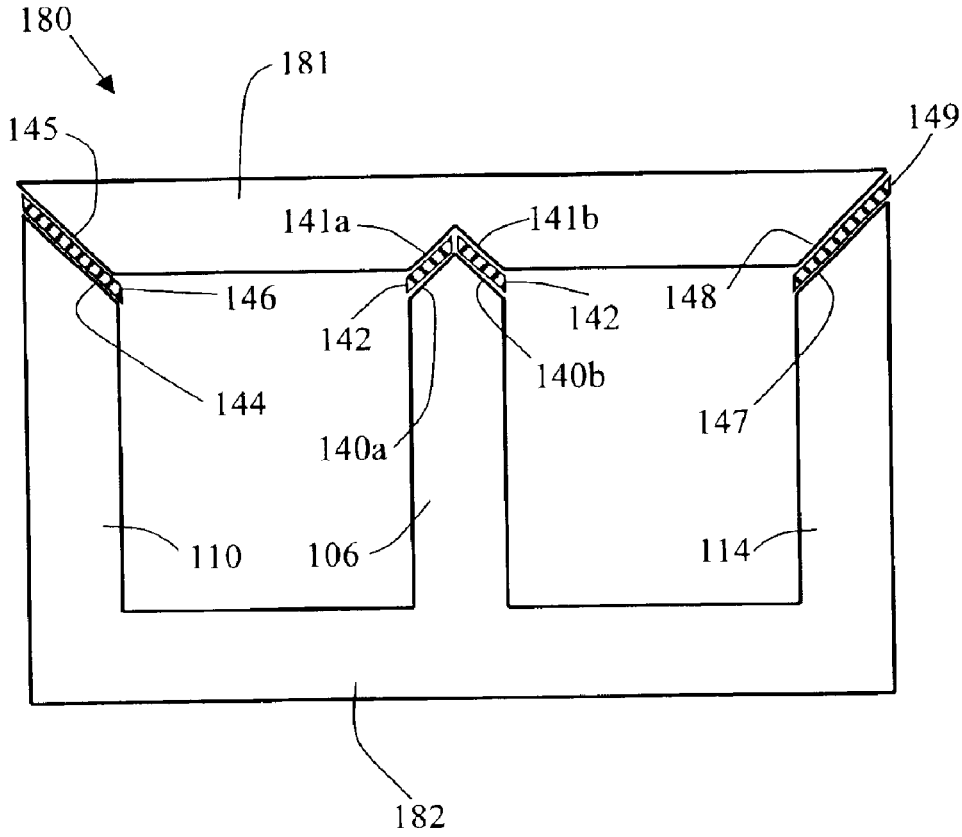
FIG. 8 is a plan view of depicting an "E-I" shaped inductive device of the invention wherein each of the mating faces of the bulk amorphous metal magnetic components is mitered.

FIG. 8 depicts another E-I implementation wherein E-I device 180 comprises mitered E component 182 and mitered I component 181. The distal end of center leg 106 of component 182 is mitered with a symmetric taper on each of its sides to form mating faces 140*a*, 140*b* and with an inwardly sloping miter at the distal end of outside legs 110, 114 to form mitered mating faces 144, 147. I component 181 is mitered at its ends at angles complementary to the miter of legs 110, 114 to form mitered end mating faces 145, 148 and at its center with a generally V-shaped notch forming mating faces 141*a*, 141*b* complementary to the mitering of leg 106. Preferably each of the faces is mitered at a 45° angle relative to the long direction of the respective portion of the component on which it is located. The lengths of legs 106, 110, 114 are chosen to permit components 181, 182 to be brought into juxtaposition with the corresponding mating faces either in intimate contact or spaced with a gap in which optional spacers 142, 146, and 149 are placed. The mitering of the mating faces depicted by FIGS. 3C and 8 advantageously increases the area of the mating face and reduces leakage flux and localized excess eddy current losses.

Figure 9:
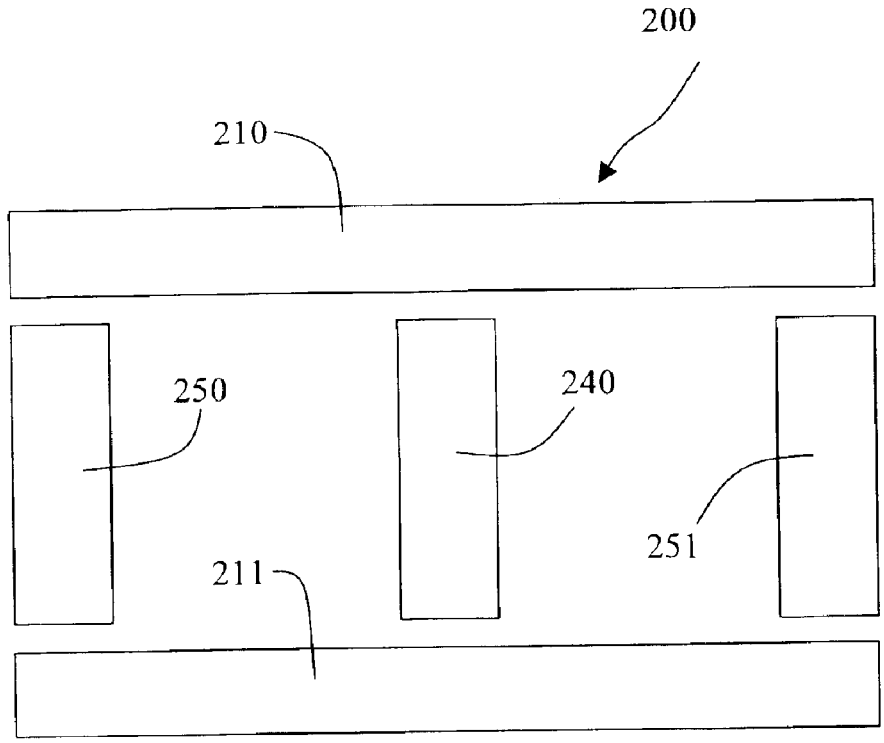
FIG. 9 is plan view depicting a generally "E-I" shaped device of the invention assembled from five "I"-shaped bulk amorphous metal magnetic components, the three leg components being of one size and the two back components being of another size.

Components having an I-shape are especially convenient for the practice of the invention, insofar as magnetic devices having a wide variety of configurations may be assembled from a few standard I-components. Using such components, a designer may easily customize a configuration to produce a device having requisite electrical characteristics for a given circuit application. For example, many applications for which the E-I device 100 depicted by FIG. 5 is suited generally may also be satisfied using a device 200 having an arrangement of five rectangular prismatic magnetic components as depicted by FIG. 9. The components comprise a first back component 210 and a second back component 211 which are of substantially identical size; and a center leg component 240, a first end leg component 250 and a second end leg component 251 of substantially identical size. Each of the five components 210, 211, 240, 250, and 251 comprises layers of ferromagnetic strip laminated to produce components of substantially the same stack height, but the back components and the leg components are generally of different respective lengths and widths. The components are disposed with all the layers of amorphous metal therein lying in parallel planes. Suitable choice of the dimensions of the components provides windows to accommodate electrical windings optimized using art-recognized principles. The windings are preferably disposed on legs 240, 250, and 251 in a manner similar to the configuration in device 100. Alternatively or additionally, windings may be placed on either or both of the back components 210, 211 between the legs. Spacers are optionally placed in the gaps between the components of device 200 to adjust the reluctance of the magnetic circuits of device 200 in the manner discussed hereinabove in connection with device 100. Mitered joints similar to those depicted by FIGS. 3C and 8 are in some instances advantageous.

Figure 10:
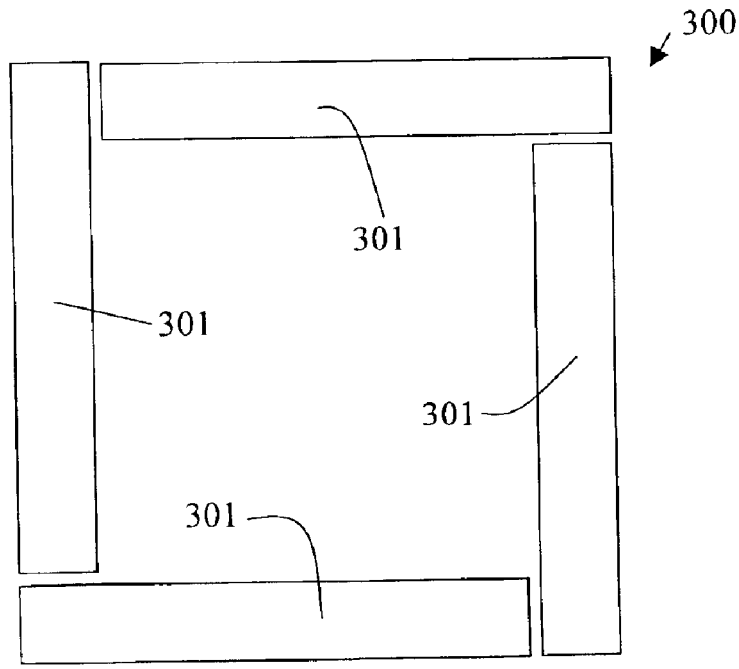
FIG. 10 is a plan view showing a square inductive device of the invention assembled from four substantially identical "I"-shaped bulk amorphous metal magnetic components.

In FIG. 10 there is depicted an embodiment of the invention wherein four substantially identical rectangular prismatic components 301 are assembled in a generally square configuration. The device 300, which is thereby formed, may be used in some applications as an alternative to the "C-I" device shown in FIG. 2. Other configurations employing rectangular shaped components of one or more sizes are useful when constructing the inductive devices of the invention. These configurations and ways for constructing inductive devices will be apparent to those skilled in the art, and are within the scope of the present invention.

Figure 11:
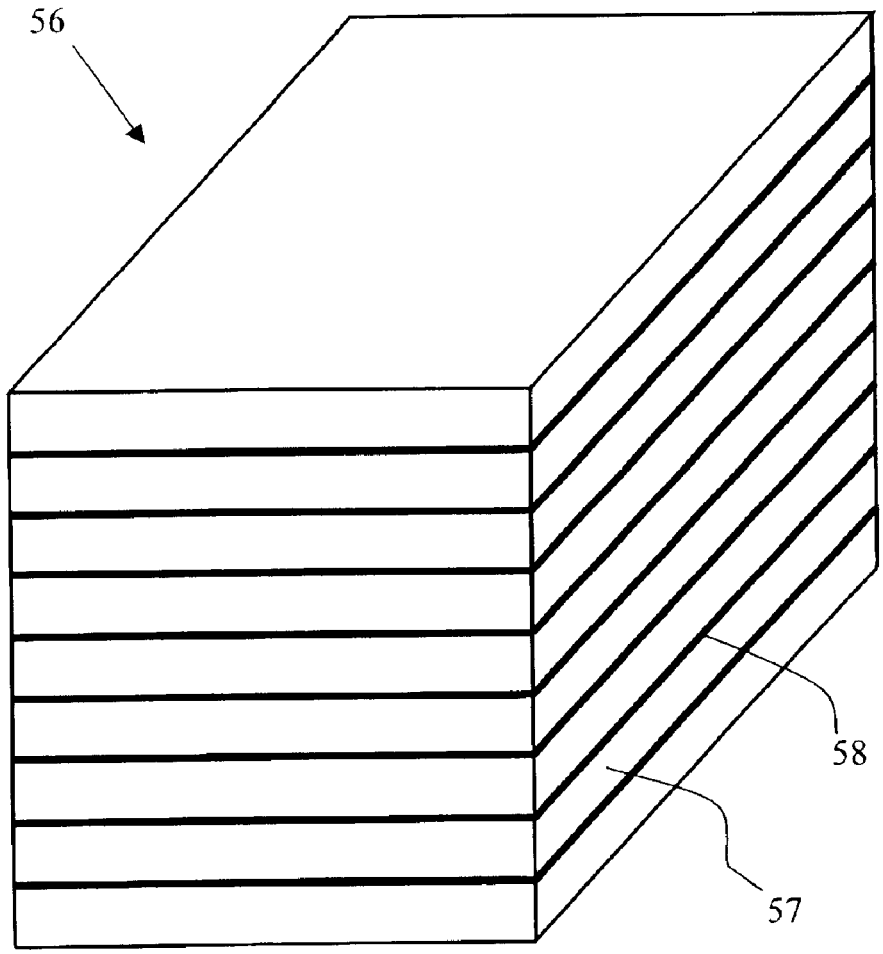
FIG. 11 is a perspective view depicting a generally rectangular prism-shaped bulk amorphous metal magnetic component used in constructing the inductive device of the invention.

As previously noted, the device of the invention utilizes at least one polyhedrally shaped component. As used herein, the term polyhedron means a multi-faced or sided solid. It includes, but is not limited to, three-dimensional rectangular, square, and prismatic shapes having mutually orthogonal sides and other shapes, such as trapezoidal prisms, having some non-orthogonal sides. In addition, any of the previously mentioned geometric shapes may include at least one, and preferably two, arcuate surfaces or sides that are disposed opposite each other to form a generally arcuately shaped component. Referring now to FIG. 11, there is depicted one form of magnetic component 56 used in constructing the device of the invention and having the shape of a rectangular prism. The component 56 is comprised of a plurality of substantially similarly shaped, generally planar layers 57 of amorphous metal strip material that are bonded together. In one aspect of the invention, the layers are annealed and then laminated by impregnation with an adhesive agent 58, preferably a low viscosity epoxy.

Figure 12:
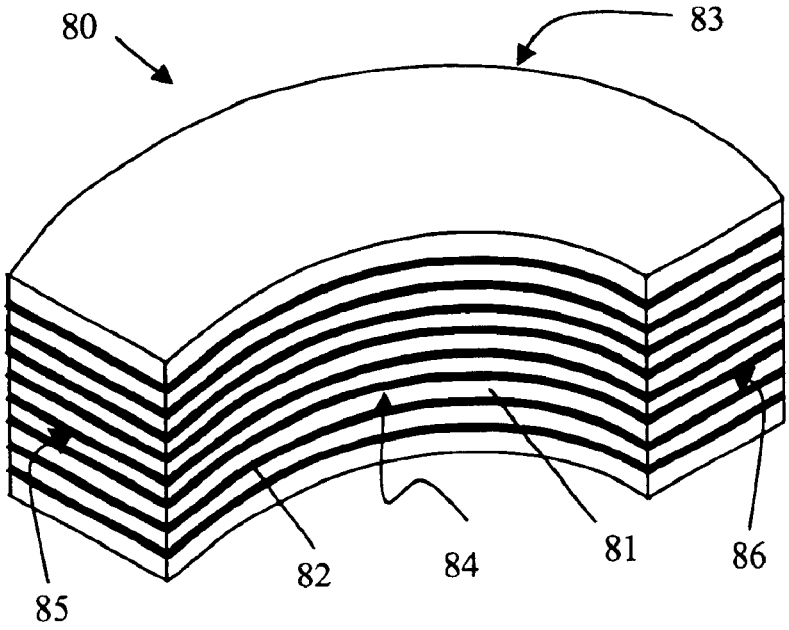
FIG. 12 is a perspective view illustrating an arcuate bulk amorphous metal magnetic component used in constructing the device of the invention.

FIG. 12 depicts another form of component 80 useful in constructing the inductive device of the invention. Arcuate component 80 comprises a plurality of arcuately shaped lamination layers 81, each of which is preferably a section of an annulus. The layers 81 are bonded together, thereby forming a polyhedrally shaped component having outside arcuate surface 83, inside arcuate surface 84, and end mating surfaces 85 and 86. Preferably, component 80 is impregnated with an adhesive agent 82 allowed to infiltrate the space between adjacent layers. Preferably, mating surfaces 85 and 86 are substantially equal in size and perpendicular to the planes of the strip layers 81.

"U"-shaped arcuate components 80 wherein surfaces 85 and 86 are coplanar are especially useful. Also preferred are arcuate components wherein surfaces 85, 86 are at angles of 120° or 90° to each other. Two, three, or four such components, respectively, are readily assembled to form an annular core which is a substantially closed magnetic circuit.

Figure 13:
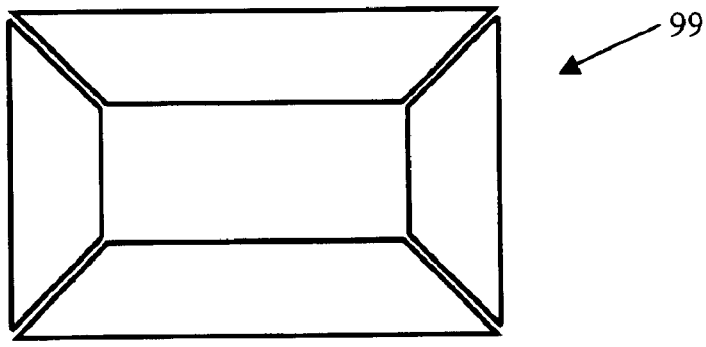
FIG. 13 is a plan view depicting an inductive device of the invention having a quadrilateral shape and assembled from four trapezoidal bulk amorphous metal magnetic components.

Still another useful shape of component is a trapezoidal prism. One embodiment of the present device comprises two pairs of trapezoidal components, the members of each pair having substantially the same dimensions. Each component has ends mitered at 45° from its elongated axis to form mating faces. The two pairs may be assembled as depicted by FIG. 13 by mating the 45° faces to form a quadrilateral rectangular configuration 99 having mitered corner joints with the members of each pair disposed on opposite sides of the quadrilateral. Advantageously, the mitered joints enlarge the contact area at the respective joints and reduce the deleterious effects of flux leakage and increased core loss.

An inductive device constructed from bulk amorphous metal magnetic components in accordance with the present invention advantageously exhibits low core loss. As is known in the magnetic materials art, core loss of a device is a function of the excitation frequency "f" and the peak induction level "$B_{max}$" to which the device is excited. In one aspect, the magnetic device has (i) a core-loss of less than or approximately equal to 1 watt-per-kilogram of amorphous metal material when operated at a frequency of approximately 60 Hz and at a flux density of approximately 1.4 Tesla (T); (ii) a core-loss of less than or approximately equal to 20 watts-per-kilogram of amorphous metal material when operated at a frequency of approximately 1000 Hz and at a flux density of approximately 1.4 T, or (iii) a core-loss of less than or approximately equal to 70 watt-per-kilogram of amorphous metal material when operated at a frequency of approximately 20,000 Hz and at a flux density of approximately 0.30 T. In accordance with another aspect, a device excited at an excitation frequency "f" to a peak induction level "$B_{max}$" may have a core loss at room temperature less than "L" wherein L is given by the formula $L=0.0074\ f\ (B^{max})^{1.3}+0.000282\ f^{1.5}\ (B_{max})^{2.4}$, the core loss, the excitation frequency and the peak induction level being measured in watts per kilogram, hertz, and teslas, respectively.

The component of the invention advantageously exhibits low core loss when the component or any portion thereof is magnetically excited along any direction substantially within the plane of the amorphous metal pieces comprised therein. The inductive device of the invention, in turn, is rendered highly efficient by the low core losses of its constituent magnetic components. The resulting low values of core loss of the device make it especially suited for use as an inductor or transformer intended for high frequency operation, e.g., for magnetic excitation at a frequency of at least about 1 kHz. The core losses of conventional steels at high frequency generally render them unsuitable for use in such inductive devices. These core loss performance values apply to the various embodiments of the present invention, regardless of the specific geometry of the bulk amorphous metal components used in constructing the inductive device.

The present invention also provides a method of constructing a bulk amorphous metal component. In one embodiment, the method comprises the steps of stamping laminations in the requisite shape from ferromagnetic amorphous metal strip feedstock, stacking the laminations to form a three-dimensional object, applying and activating adhesive means to adhere the laminations to each other and give the component sufficient mechanical integrity, and optionally finishing the component to remove any excess adhesive and give it a suitable surface finish and final component dimensions. The method may further comprise an optional annealing step to improve the magnetic properties of the component. These steps may be carried out in a variety of orders and using a variety of techniques including those set forth hereinbelow and others which will be obvious to those skilled in the art.

Historically, three factors have combined to preclude the use of stamping as a viable approach to forming amorphous metal parts. First and foremost, amorphous metal strip is typically thinner than conventional magnetic material strip such as non-oriented electrical steel sheet. The use of thinner materials dictates that more laminations are required to build a given-shaped part. The use of thinner materials also requires smaller tool and die clearances in the stamping process.

Secondly, amorphous metals tend to be significantly harder than typical metallic punch and die materials. Iron based amorphous metal typically exhibits hardness in excess of 1100 kg/mm$^2$. By comparison, air cooled, oil quenched and water quenched tool steels are restricted to hardness in the 800 to 900 kg/mm$^2$ range. Thus, the amorphous metals, which derive their hardness from their unique atomic structures and chemistries, are harder than conventional metallic punch and die materials.

Thirdly, amorphous metals can undergo significant deformation, rather than rupture, prior to failure when constrained between the punch and die during stamping. Amorphous metals deform by highly localized shear flow. When deformed in tension, such as when an amorphous metal strip is pulled, the formation of a single shear band can lead to failure at small, overall deformation. In tension, failure can occur at an elongation of 1% or less. However, when deformed in a manner such that a mechanical constraint precludes plastic instability, such as in bending between the tool and die during stamping, multiple shear bands are formed and significant localized deformation can occur. In such a deformation mode, the elongation at failure can locally exceed 100%.

These latter two factors, exceptional hardness plus significant deformation, combine to produce extraordinary wear on the punch and die components of the stamping press using conventional stamping equipment, tooling and processes. Wear on the punch and die occurs by direct abrasion of the hard amorphous metal rubbing against the softer punch and die materials during deformation prior to failure.

The present invention provides a method for minimizing the wear on the punch and die during the stamping process. The method comprises the steps of fabricating the punch and die tooling from carbide materials, fabricating the tooling such that the clearance between the punch and the die is small and uniform, and operating the stamping process at high strain rates. The carbide materials used for the punch and die tooling should have a hardness of at least 1100 kg/mm$^2$ and preferably greater than 1300 kg/mm$^2$. Carbide tooling with hardness equal to or greater than that of amorphous metal will resist direct abrasion from the amorphous metal during the stamping process thereby minimizing the wear on the punch and die. The clearance between the punch and the die should be less than 0.050 mm (0.002 inch) and preferably less than 0.025 mm (0.001 inch). The strain rate used in the stamping process should be that created by at least one punch stroke per second and preferably at least five punch strokes per second. For amorphous metal strip that is 0.025 mm (0.001 inch) thick, this range of stroke speeds is approximately equivalent to a deformation rate of at least $10^5$/sec and preferably at least $5\times10^5$/sec. The small clearance between the punch and the die and the high strain rate used in the stamping process combine to limit the amount of mechanical deformation of the amorphous metal prior to failure during the stamping process. Limiting the mechanical deformation of the amorphous metal in the die cavity limits the direct abrasion between the amorphous metal and the punch and die process thereby minimizing the wear on the punch and die.

Figure 14:
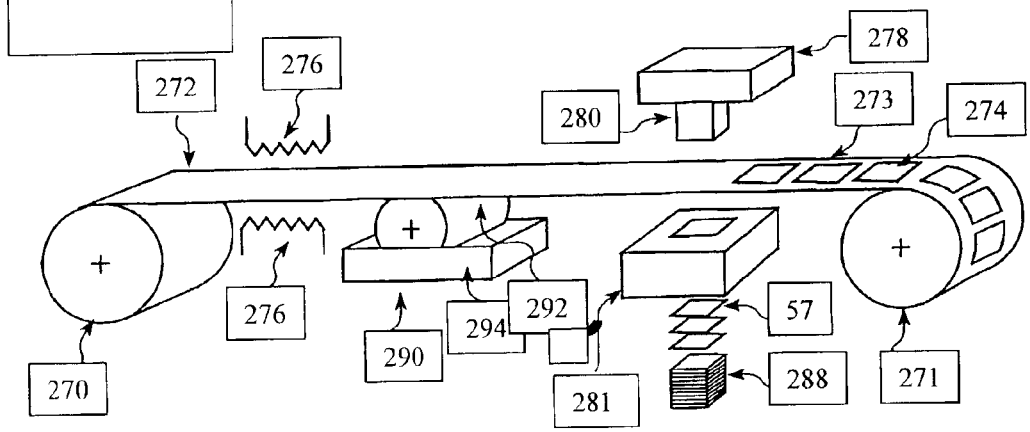
FIG. 14 is a schematic depiction of an apparatus and process for stamping laminations from an amorphous metal ribbon and stacking, registering, and bonding the laminations to form a bulk amorphous metal magnetic component of the invention.

One form of the method of punching laminations for the component of the invention is depicted by FIG. 14. A roll 270 of ferromagnetic amorphous metal strip material 272 is fed continuously through an annealing oven 276 which raises its temperature to a level and for a time sufficient to effect improvement in the magnetic properties of strip 272. Strip 272 is then passed through an adhesive application means 290 comprising a gravure roller 292 onto which low-viscosity, heat-activated epoxy is supplied from adhesive reservoir 294. The epoxy is thereby transferred from roller 292 onto the lower surface of strip 272. The distance between annealing oven 276 and the adhesive application means 290 is sufficient to allow strip 272 to cool to a temperature at least below the thermal activation temperature of epoxy during the transit time of strip 272. Alternatively, cooling means (not illustrated) may be used to achieve a more rapid cooling of strip 272 between oven 276 and application means 280. Strip material 272 is then passed into an automatic high-speed punch press 278 and between a punch 280 and an open-bottom die 281. The punch is driven into the die causing a lamination 57 of the required shape to be formed. The lamination 57 then falls or is transported into a collecting magazine 288 and punch 280 is retracted. A skeleton 273 of strip material 272 remains and contains holes 274 from which laminations 57 have been removed. Skeleton 273 is collected on take-up spool 271. After each punching action is accomplished the strip 272 is indexed to prepare the strip for another punching cycle. The punching process is continued and a plurality of laminations 57 are collected in magazine 288 in sufficiently well aligned registry. After a requisite number of laminations 57 are punched and deposited into the magazine 288, the operation of punch press 278 is interrupted. The requisite number may either be pre-selected or may be determined by the height or weight of laminations 57 received in magazine 288. Magazine 288 is then removed from punch press 278 for further processing. Additional low-viscosity, heat-activated epoxy (not shown) may be allowed to infiltrate the spaces between the laminations 57 which are maintained in registry by the walls of magazine 288. The epoxy is then activated by exposing the entire magazine 288 and laminations 57 contained therein to a source of heat for a time sufficient to effect the cure of the epoxy. The now laminated stack of laminations 57 is removed from the magazine and the surface of the stack is optionally finished by removing any excess epoxy.

A method especially preferred for cutting small, intricately shaped laminations, is photolithographic etching, which is often termed simply, photoetching. Generally stated, photolithographic etching is a known technique in the metal working art for forming pieces of a material supplied the form of a relatively thin sheet, strip, or ribbon. The photoetching process may comprise the steps of: (i) applying on the sheet a layer of a photoresistive substance responsive to the impingement thereon of light; (ii) interposing a photographic mask having regions of relative transparency and opacity defining a preselected shape between the photoresistive substance and a source of light to which the photoresist responds; (iii) impinging the light onto the mask to selectively expose those regions of the photoresistive substance located behind the transparent areas of the mask; (iv) developing the photoresistive substance by treatment with heat or chemical agents that causes the exposed regions of the photoresistive layer to be differentiated from the unexposed regions; (v) selectively removing the exposed portions of the developed photoresistive layer; and (vi) placing the sheet in a bath of corrosive agent that selectively etches or erodes material from those portions of the sheet from which the developed photoresist has been removed but does not erode portions on which photoresist remains, thereby forming laminations having the preselected shape. Most frequently the mask will include features that define small holding regions that leave each lamination weakly connected to the sheet for ease of handling prior to final assembly. These holding regions are easily severed to allow removal of individual laminations from the main sheet. A further chemical step is also normally used to remove residual photoresist from the laminations after the corrosive etching step. Those skilled in the art will also recognize photolithographic etching processes that use complementary photoresist materials in which the unexposed portions of the photoresist are selectively removed in step (v) above, instead of exposed portions. Such a change also necessitates the transposition of the opaque and transparent regions in the photomask to create the same final lamination structure.

Methods of forming laminations that do not produce burrs or other edge defects are especially preferred. More specifically, these and other defects that protrude from the plane of the lamination are formed in some processes under and under certain conditions. Interlaminar electrical shorting often results in a magnetic component comprising such defected laminations, deleteriously increasing the component's iron loss.

Advantageously, photoetching of a part generally is found to promote this objective. Typically photoetched parts exhibit rounded edges and tapering of the part's thickness in the immediate vicinity of the edges, thereby minimizing the likelihood of the aforementioned interlaminar shorting in a lamination stack of such parts. In addition, the impregnation of such a stack with an adhesive agent is facilitated by the enhancement of wicking and capillary action in the vicinity of the tapered edges. The efficacy of impregnation may further be enhanced by the provision of one or more small holes through each lamination. When the individual laminations are stacked in registry, such holes may be aligned to create a channel through which an impregnant may readily flow, thereby assuring that the impregnant is present over at least a substantial area of the surface at which each lamination is mated with the adjacent laminations. Other structures, such as surface channels and slots may also be incorporated into each lamination that also may serve as impregnant flow enhancement means. The aforementioned holes and flow enhancement means are readily and effectively produced in photoetched laminations. In addition, various spacers may be interposed in the lamination stack to promote flow enhancement.

Adhesive means are used in the practice of this invention to adhere a plurality of pieces or laminations of amorphous metal strip material in suitable registry to each other, thereby providing a bulk, three-dimensional object. This bonding affords sufficient structural integrity that permits the present component to be handled and incorporated into a larger structure, without concomitantly producing excessive stress that would result in high core loss or other unacceptable degradation of magnetic properties. A variety of adhesive agents may be suitable, including those composed of epoxies, varnishes, anaerobic adhesives, cyanoacrylates, and room-temperature-vulcanized (RTV) silicone materials. Adhesives desirably have low viscosity, low shrinkage, low elastic modulus, high peel strength, and high dielectric strength. The adhesive may cover any fraction of the surface area of each lamination sufficient to effect adequate bonding of adjacent laminations to each other and thereby impart sufficient strength to give the finished component mechanical integrity. The adhesive may cover up to substantially all the surface area. Epoxies may be either multi-part whose curing is chemically activated or single-part whose curing is activated thermally or by exposure to ultra-violet radiation. Preferably, the adhesive has a viscosity of less than 1000 cps and a thermal expansion coefficient approximately equal to that of the metal, or about 10 ppm.

Suitable methods for applying the adhesive include dipping, spraying, brushing, and electrostatic deposition. In strip or ribbon form amorphous metal may also be coated by passing it over rods or rollers which transfer adhesive to the amorphous metal. Rollers or rods having a textured surface, such as gravure or wire-wrapped rollers, are especially effective in transferring a uniform coating of adhesive onto the amorphous metal. The adhesive may be applied to an individual layer of amorphous metal at a time, either to strip material prior to cutting or to laminations after cutting. Alternatively, the adhesive means may be applied to the laminations collectively after they are stacked. Preferably, the stack is impregnated by capillary flow of the adhesive between the laminations. The impregnation step may be carried out at ambient temperature and pressure. Alternatively but preferably, the stack may be placed either in vacuum or under hydrostatic pressure to effect more complete filling, yet minimize the total volume of adhesive added. This procedure assures high stacking factor and is therefore preferred. A low-viscosity adhesive agent, such as an epoxy or cyanoacrylate is preferably used. Mild heat may also be used to decrease the viscosity of the adhesive, thereby enhancing its penetration between the lamination layers. The adhesive is activated as needed to promote its bonding. After the adhesive has received any needed activation and curing, the component may be finished to accomplish at least one of removing any excess adhesive, giving it a suitable surface finish, and giving it the final component dimensions. If carried out at a temperature of at least about 175° C., the activation or curing of the adhesive may also serve to affect magnetic properties as discussed in greater detail hereinbelow.

One preferred adhesive is a thermally activated epoxy sold under the tradename Epoxylite 8899 by the P. D. George Co. The device of the invention is preferably bonded by impregnation with this epoxy, diluted 1:5 by volume with acetone to reduce its viscosity and enhance its penetration between the layers of the ribbon. The epoxy may be activated and cured by exposure to an elevated temperature, e.g. a temperature ranging from about 170 to 180° C. for a time ranging from about 2 to 3 h. Another adhesive found to be preferable is a methyl cyanoacrylate sold under the trade name Permabond 910FS by the National Starch and Chemical Company. The device of the invention is preferably bonded by applying this adhesive such that it will penetrate between the layers of the ribbon by capillary action. Permabond 910FS is a single part, low viscosity liquid that will cure at room temperature in the presence of moisture in 5 seconds.

The present invention further provides a method of assembling a plurality of bulk amorphous metal magnetic components to form an inductive device having a magnetic core. The method comprises the steps of: (i) encircling at least one of the components with an electrical winding; (ii) positioning the components in juxtaposed relationship to form the core which has at least one magnetic circuit, and wherein the layers of each component lie in substantially parallel planes; and (iii) securing the components in juxtaposed relationship.

The arrangement of the components assembled in the device of the invention is secured by any suitable securing means. Preferably the securing means does not impart high stress to the constituent components that would result in degradation of magnetic properties such as permeability and core loss. The components are preferably banded with an encircling band, strip, tape, or sheet made of metal, polymer, or fabric. In another embodiment of the invention the securing means comprises a relatively rigid housing or frame, preferably made of a plastic or polymer material, having one or more cavities into which the constituent components are fitted. Suitable materials for the housing include nylon and glass-filled nylon. More preferable materials include polyethylene terephthalate and polybutylene terephthalate, which are available commercially from DuPont under the tradename Rynite PET thermoplastic polyester. The shape and placement of the cavities secures the components in the requisite alignment. In still another embodiment, the securing means comprises a rigid or semi-rigid external dielectric coating or potting. The constituent components are disposed in the requisite alignment. Coating or potting is then applied to at least a portion of the external surface of the device and suitably activated and cured to secure the components. In some implementations one or more windings are applied prior to application of the coating or potting. Various coatings and methods are suitable, including epoxy resins. If required, the finishing operation may include removal of any excess coating. An external coating beneficially protects the insulation of electrical windings on components from abrasion at sharp metal edges and acts to trap any flakes or other material which might tend to come off the component or otherwise become lodged inappropriately in the device or other nearby structure.

Optionally the fabrication of the component further comprises the step of preparing mating faces on the component, the faces being substantially planar and perpendicular to the constituent layers. If necessary, preparing the faces may comprise a planing operation to refine the mating faces and remove any asperities or non-planarity. The planing preferably comprises at least one of milling, surface grinding, cutting, polishing, chemical etching, and electro-chemical etching, or similar operation, to provide a planar mating surface. The planing step is especially preferred for mating faces located on the side of a component to counter any effects of imperfect registration of the amorphous metal layers.

The various securing techniques may be practiced in combination to provide additional strength against externally imposed mechanical forces and magnetic forces attendant to the excitation of the component during operation.

Inductive devices incorporating bulk amorphous metal magnetic components constructed in accordance with the present invention are especially suited as inductors and transformers for a wide variety of electronic circuit devices, notably including power conditioning circuit devices such as power supplies, voltage converters, and similar power conditioning devices operating using switch-mode techniques at switching frequencies of 1 kHz or more. The low losses of the present inductive device advantageously improves the efficiency of such electronic circuit devices. Magnetic component manufacturing is simplified and manufacturing time is reduced. Stresses otherwise encountered during the construction of bulk amorphous metal components are minimized. Magnetic performance of the finished devices is optimized.

The bulk amorphous metal magnetic components used in the practice of the present invention can be manufactured using numerous amorphous metal alloys. Generally stated, the alloys suitable for use in constructing the component of the present invention are defined by the formula: $M_{70-85}Y_{5-20}Z_{0-20}$ subscripts in atom percent, where "M" is at least one of Fe, Ni and Co, "Y" is at least one of B, C and P, and "Z" is at least one of Si, Al and Ge; with the proviso that (i) up to ten (10) atom percent of component "M" can be replaced with at least one of the metallic species Ti, V, Cr, Mn, Cu, Zr, Nb, Mo, Ta and W, and (ii) up to ten (10) atom percent of components (Y+Z) can be replaced by at least one of the non-metallic species In, Sn, Sb and Pb. As used herein, the term "amorphous metallic alloy" means a metallic alloy that substantially lacks any long range order and is characterized by X-ray diffraction intensity maxima which are qualitatively similar to those observed for liquids or inorganic oxide glasses.

Amorphous metal alloys suitable as feedstock in the practice of the invention are commercially available, generally in the form of continuous thin strip or ribbon in widths up to 20 cm or more and in thicknesses of approximately 20–25 $\mu$m. These alloys are formed with a substantially fully glassy microstructure (e.g., at least about 80% by volume of material having a non-crystalline structure). Preferably the alloys are formed with essentially 100% of the material having a non-crystalline structure. Volume fraction of non-crystalline structure may be determined by methods known in the art such as x-ray, neutron, or electron diffraction, transmission electron microscopy, or differential scanning calorimetry. Highest induction values at low cost are achieved for alloys wherein "M," "Y," and "Z" are at least predominantly iron, boron, and silicon, respectively. Accordingly, it is preferred that the alloy contain at least 70 atom percent Fe, at least 5 atom percent B, and at least 5 atom percent Si, with the proviso that the total content of B and Si be at least 15 atom percent. Amorphous metal strip composed of an iron-boron-silicon alloy is also preferred. Most preferred is amorphous metal strip having a composition consisting essentially of about 11 atom percent boron and about 9 atom percent silicon, the balance being iron and incidental impurities. This strip, having a saturation induction of about 1.56 T and a resistivity of about 137 $\mu\Omega$-cm, is sold by Honeywell International Inc. under the trade designation METGLAS® alloy 2605SA-1. Another suitable amorphous metal strip has a composition consisting essentially of about 13.5 atom percent boron, about 4.5 atom percent silicon, and about 2 atom percent carbon, the balance being iron and incidental impurities. This strip, having a saturation induction of about 1.59 T and a resistivity of about 137 $\mu\Omega$-cm, is sold by Honeywell International Inc. under the trade designation METGLAS® alloy 2605SC. For applications in which even higher saturation induction is desired, strip having a composition consisting essentially of iron, along with about 18 atom percent Co, about 16 atom percent boron, and about 1 atom percent silicon, the balance being iron and incidental impurities, is suitable. Such strip is sold by Honeywell International Inc. under the trade designation METGLAS® alloy 2605CO. However, losses of a component constructed with this material tend to be slightly higher than those using METGLAS 2605SA-1.

As is known in the art, a ferromagnetic material may be characterized by its saturation induction or equivalently, by its saturation flux density or magnetization. An alloy suitable for use in the present invention preferably has a saturation induction of at least about 1.2 tesla (T) and, more preferably, a saturation induction of at least about 1.5 T. The alloy also has high electrical resistivity, preferably at least about 100 $\mu\Omega$-cm, and most preferably at least about 130 $\mu\Omega$-cm.

Mechanical and magnetic properties of the amorphous metal strip appointed for use in the component generally may be enhanced by thermal treatment at a temperature and for a time sufficient to provide the requisite enhancement without altering the substantially fully glassy microstructure of the strip. Generally, the temperature is selected to be about 100–175° C. below the alloy's crystallization temperature and the time ranges from about 0.25–8 h. The heat treatment comprises a heating portion, an optional soak portion and a cooling portion. A magnetic field may optionally be applied to the strip during at least a portion, such as during at least the cooling portion, of the heat treatment. Application of a field, preferably directed substantially along the direction in which flux lies during operation of the component, may in some cases further improve the magnetic properties and reduce the core loss of the component. Optionally, the heat treatment comprises more than one such heat cycle. Furthermore, the one or more heat treatment cycles may be carried out at different stages of the component manufacture. For example, discrete laminations may be treated or the lamination stack may be heat treated either before or after adhesive bonding. Preferably, the heat treatment is carried out before bonding, since many otherwise attractive adhesives will not withstand the requisite heat treatment temperatures.

The thermal treatment of the amorphous metal may employ any heating means which results in the metal experiencing the required thermal profile. Suitable heating means include infra-red heat sources, ovens, fluidized beds, thermal contact with a heat sink maintained at an elevated temperature, resistive heating effected by passage of electrical current through the strip, and inductive (RF) heating. The choice of heating means may depend on the ordering of the required processing steps enumerated above.

Furthermore, the heat treatment may be carried out at different stages during the course of processing the component and device of the invention. In some cases, heat treatment of feedstock strip material prior to formation of discrete laminations is preferred. Bulk spools may be treated off-line, preferably in an oven or fluidized bed, or an in-line, continuous spool-to-spool process wherein strip passes from a payoff spool, through a heated zone, and onto a take-up spool may be employed. A spool-to-spool process may also be integrated with a continuous punching or photolithographic etching process.

The heat treatment also may be carried out on discrete laminations after the photolithographic etching or punching steps, but before stacking. In this embodiment, it is preferred that the laminations exit the cutting process and are directly deposited onto a moving belt which conveys them through a heated zone, thereby causing the laminations to experience the appropriate time-temperature profile.

In still another implementation, the heat treatment is carried out after discrete laminations are stacked in registry. Suitable heating means for annealing such a stack include ovens, fluidized beds, and induction heating.

Heat treatment of the strip material prior to stamping may alter the mechanical properties of the amorphous metal. Specifically, heat treatment will reduce the ductility of the amorphous metal, thereby limiting the amount of mechanical deformation in the amorphous metal prior to fracture during the stamping process. Reduced ductility of the amorphous metal will also reduce the direct abrasion and wear of the punch and die materials by the deforming amorphous metal.

The magnetic properties of certain amorphous alloys suitable for use in the present component may be significantly improved by heat treating the alloy to form a nanocrystalline microstructure. This microstructure is characterized by the presence of a high density of grains having average size less than about 100 nm, preferably less than 50 nm, and more preferably about 10–20 nm. The grains preferably occupy at least 50% of the volume of the iron-base alloy. These preferred materials have low core loss and low magnetostriction. The latter property also renders the material less vulnerable to degradation of magnetic properties by stresses resulting from the fabrication and/or operation of a device comprising the component. The heat treatment needed to produce the nanocrystalline structure in a given alloy must be carried out at a higher temperature or for a longer time than would be needed for a heat treatment designed to preserve therein a substantially fully glassy microstructure. As used herein the terms amorphous metal and amorphous alloy further include a material initially formed with a substantially fully glassy microstructure and subsequently transformed by heat treatment or other processing to a material having a nanocrystalline microstructure. Amorphous alloys that may be heat treated to form a nanocrystalline microstructure are also often termed, simply, nanocrystalline alloys. The present method allows a nanocrystalline alloy to be formed into the requisite geometrical shape of the finished bulk magnetic component. Such formation is advantageously accomplished while the alloy is still in its as-cast, ductile, substantially non-crystalline form, before it is heat treated to form the nanocrystalline structure which generally renders it more brittle and more difficult to handle. Typically the nanocrystallization heat treatment is carried out at a temperature ranging from about 50° C. below the alloy's crystallization temperature to about 50° C. thereabove.

Two preferred classes of alloy having magnetic properties significantly enhanced by formation therein of a nanocrystalline microstructure are given by the following formulas in which the subscripts are in atom percent.

A first preferred class of nanocrystalline alloy is $Fe_{100-u-x-y-z-w}R_uT_xQ_yB_zSi_w$, wherein R is at least one of Ni and Co, T is at least one of Ti, Zr, Hf, V, Nb, Ta, Mo, and W, Q is at least one of Cu, Ag, Au, Pd, and Pt, u ranges from 0 to about 10, x ranges from about 3 to 12, y ranges from 0 to about 4, z ranges from about 5 to 12, and w ranges from 0 to less than about 8. After this alloy is heat treated to form a nanocrystalline microstructure therein, it has high saturation induction (e.g., at least about 1.5 T), low core loss, and low saturation magnetostriction (e.g. a magnetostriction having an absolute value less than $4\times10^{-6}$). Such an alloy is especially preferred for applications wherein a device of minimum size is demanded.

A second preferred class of nanocrystalline alloy is $Fe_{100-u-x-y-z-w}R_uT_xQ_yB_zSi_w$, wherein R is at least one of Ni and Co, T is at least one of Ti, Zr, Hf, V, Nb, Ta, Mo, and W, Q is at least one of Cu, Ag, Au, Pd, and Pt, u ranges from 0 to about 10, x ranges from about 1 to 5, y ranges from 0 to about 3, z ranges from about 5 to 12, and w ranges from about 8 to 18. After this alloy is heat treated to form a nanocrystalline microstructure therein, it has a saturation induction of at least about 1.0 T, an especially low core loss, and low saturation magnetostriction (e.g. a magnetostriction having an absolute value less than $4\times10^{-6}$). Such an alloy is especially preferred for use in a device required to operate at very excitation frequency, e.g. 1000 Hz or more.

Bulk amorphous magnetic components will magnetize and demagnetize more efficiently than components made from other iron-base magnetic metals. When incorporated in an inductive device, the bulk amorphous metal component will generate less heat than a comparable component made from another iron-base magnetic metal when the two components are magnetized at identical induction and frequency. An inductive device using the bulk amorphous metal component can therefore be designed to operate: (i) at a lower operating temperature; (ii) at higher induction to achieve reduced size and weight and increased energy storage or transfer; or (iii) at higher frequency to achieve reduced size and weight, when compared to inductive devices incorporating components made from other iron-base magnetic metals.

As is known in the art, core loss is that dissipation of energy which occurs within a ferromagnetic material as the magnetization thereof is changed with time. The core loss of a given magnetic component is generally determined by cyclically exciting the component. A time-varying magnetic field is applied to the component to produce therein a corresponding time variation of the magnetic induction or flux density. For the sake of standardization of measurement the excitation is generally chosen such that the magnetic induction is homogeneous in the sample and varies sinusoidally with time at a frequency "f" and with a peak amplitude $B_{max}$. The core loss is then determined by known electrical measurement instrumentation and techniques. Loss is conventionally reported as watts per unit mass or volume of the magnetic material being excited. It is known in the art that loss increases monotonically with f and $B_{max}$. Most standard protocols for testing the core loss of soft magnetic materials used in inductive devices {e.g. ASTM Standards A912-93 and A927 (A927M-94)} call for a sample of such materials which is situated in a substantially closed magnetic circuit, i.e. a configuration in which closed magnetic flux lines are substantially contained within the volume of the sample and the magnetic material cross-section is substantially identical throughout the magnetic circuit. On the other hand, the magnetic circuit in an actual inductive device, especially a flyback transformer or an energy storage inductor, may be rendered relatively open by the presence of high-reluctance gaps that magnetic flux lines must traverse. Because of fringing field effects and non-uniformity of the field, a given material tested in an open circuit generally exhibits a higher core loss, i.e. a higher value of watts per unit mass or volume, than it would have in a closed-circuit measurement. The bulk magnetic component of the invention advantageously exhibits low core loss over a wide range of flux densities and frequencies even in a relatively open-circuit configuration.

Without being bound by any theory, it is believed that the total core loss of the low-loss bulk amorphous metal device of the invention is comprised of contributions from hysteresis losses and eddy current losses. Each of these two contributions is a function of the peak magnetic induction $B_{max}$ and of the excitation frequency f. Prior art analyses of core losses in amorphous metals (see, e.g., G. E. Fish, J. Appl. Phys. 57, 3569(1985) and G. E. Fish et al., J. Appl. Phys. 64, 5370(1988)) have generally been restricted to data obtained for material in a closed magnetic circuit.

The analysis of the total core loss $L(B_{max}, f)$ per unit mass of the device of the invention is simplest in a configuration having a single magnetic circuit and a substantially identical effective magnetic material cross-sectional area. In that case, the loss may be generally be defined by a function having the form $$L(B_{max}, f)=c_1f(B_{max})^n+c_2f^q(B_{max})^m$$

wherein the coefficients $c_1$ and $c_2$ and the exponents n, m, and q must all be determined empirically, there being no known theory that precisely determines their values. Use of this formula allows the total core loss of the device of the invention to be determined at any required operating induction and excitation frequency. It is sometimes found that in the particular geometry of an inductive device the magnetic field therein is not spatially uniform, especially in implementations having a plurality of magnetic circuits and material cross-sections, such as are generally used for three-phase devices. Techniques such as finite element modeling are known in the art to provide an estimate of the spatial and temporal variation of the peak flux density that closely approximates the flux density distribution measured in an actual device. Using as input a suitable empirical formula giving the magnetic core loss of a given material under spatially uniform flux density, these techniques allow the corresponding actual core loss of a given component in its operating configuration to be predicted with reasonable accuracy by numerical integration over the device volume.

The measurement of the core loss of the magnetic device of the invention can be accomplished using various methods known in the art. Determination of the loss is especially straightforward in the case of a device with a single magnetic circuit and substantially constant cross-section. A suitable method comprises provision of a device with a primary and a secondary electrical winding, each encircling one or more components of the device. Magnetomotive force is applied by passing current through the primary winding. The resulting flux density is determined by Faraday's law from the voltage induced in the secondary winding. The applied magnetic field is determined by Ampère's law from the magnetomotive force. The core loss is then computed from the applied magnetic field and the resulting flux density by conventional methods.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLE 1

Preparation and Electro-Magnetic Testing of an Inductive Device Comprising Stamped Amorphous Metal Arcuate Components $Fe_{80}B_{11}Si_9$ ferromagnetic amorphous metal ribbon, approximately 60 mm wide and 0.022 mm thick, is stamped to form individual laminations, each having the shape of a 90° segment of an annulus 100 mm in outside diameter and 75 mm in inside diameter. Approximately 500 individual laminations are stacked and registered to form a 90° arcuate segment of a right circular cylinder having a 12.5 mm height, a 100 mm outside diameter, and a 75 mm inside diameter, generally as illustrated by FIG. 12. The cylindrical segment assembly is placed in a fixture and annealed in a nitrogen atmosphere. The anneal consists of: 1) heating the assembly up to 365° C.; 2) holding the temperature at approximately 365° C. for approximately 2 hours; and, 3) cooling the assembly to ambient temperature. The cylindrical segment assembly is removed from the fixture. The cylindrical segment assembly is placed in a second fixture, vacuum impregnated with an epoxy resin solution, and cured at 120° C. for approximately 4.5 hours. When fully cured, the cylindrical segment assembly is removed from the second fixture. The resulting epoxy bonded, amorphous metal cylindrical segment assembly weighs approximately 70 g. The process is repeated to form a total of four such assemblies. The four assemblies are placed in mating relationship and banded to form a generally cylindrical test core having four equally spaced gaps. Primary and secondary electrical windings are fixed to the cylindrical test core for electrical testing.

The test assembly exhibits core loss values of less than 1 watt-per-kilogram of amorphous metal material when operated at a frequency of approximately 60 Hz and at a flux density of approximately 1.4 Tesla (T), a core-loss of less than 12 watts-per-kilogram of amorphous metal material when operated at a frequency of approximately 1000 Hz and at a flux density of approximately 1.0 T, and a core-loss of less than 70 watt-per-kilogram of amorphous metal material when operated at a frequency of approximately 20,000 Hz and at a flux density of approximately 0.30 T. The low core loss of the test core renders it suitable for use in an inductive device of the invention.

EXAMPLE 2

High Frequency Electro-Magnetic Testing of an Inductive Device Comprising Stamped Amorphous Metal Arcuate Components A cylindrical test core comprising four stamped amorphous metal arcuate components is prepared as in Example 1. Primary and secondary electrical windings are fixed to the test assembly. Electrical testing is carried out at 60, 1000, 5000, and 20,000 Hz and at various flux densities. Core loss values are measured and compared to catalogue values for other ferromagnetic materials in similar test configurations (National-Arnold Magnetics, 17030 Muskrat Avenue, Adelanto, Calif. 92301 (1995)). The test data are compiled in Tables 1, 2, 3, and 4 below. As best shown by the data in Tables 3 and 4, the core loss is particularly low at excitation frequencies of 5000 Hz or more. Such low core loss makes the magnetic component of the invention especially well suited for use in constructing inductive devices of the present invention. A cylindrical test core constructed in accordance with this Example is suitable for use in an inductive device, such as an inductor used in a switch-mode power supply.

TABLE 1

| | Core Loss @ 60 Hz (W/kg) | | | | |
|---|---|---|---|---|---|
| | Material | | | | |
| Flux Density | Amorphous $Fe_{80}B_{11}Si_9$ (22 μm) | Crystalline Fe-3% Si (25 μm) National-Arnold Magnetics Silectron | Crystalline Fe-3% Si (50 μm) National-Arnold Magnetics Silectron | Crystalline Fe-3% Si (175 μm) National-Arnold Magnetics Silectron | Crystalline Fe-3% Si (275 μm) National-Arnold Magnetics Silectron |
| 0.3 T | 0.10 | 0.2 | 0.1 | 0.1 | 0.06 |
| 0.7 T | 0.33 | 0.9 | 0.5 | 0.4 | 0.3 |
| 0.8 T | | 1.2 | 0.7 | 0.6 | 0.4 |
| 1.0 T | | 1.9 | 1.0 | 0.8 | 0.6 |
| 1.1 T | 0.59 | | | | |
| 1.2 T | | 2.6 | 1.5 | 1.1 | 0.8 |
| 1.3 T | 0.75 | | | | |
| 1.4 T | 0.85 | 3.3 | 1.9 | 1.5 | 1.1 |

TABLE 2

| | Core Loss @ 1,000 Hz (W/kg) | | | | |
|---|---|---|---|---|---|
| | Material | | | | |
| Flux Density | Amorphous $Fe_{80}B_{11}Si_9$ (22 μm) | Crystalline Fe-3% Si (25 μm) National-Arnold Magneties Silectron | Crystalline Fe-3% Si (50 μm) National-Arnold Magneties Silectron | Crystalline Fe-3% Si (175 μm) National-Arnold Magneties Silectron | Crystalline Fe-3% Si (275 μm) National-Arnold Magneties Silectron |
| 0.3 T | 1.92 | 2.4 | 2.0 | 3.4 | 5.0 |
| 0.5 T | 4.27 | 6.6 | 5.5 | 8.8 | 12 |
| | Material | | | | |
| Flux Density | Amorphous $Fe_{80}B_{11}Si_9$ (22 μm) | Crystalline Fe-3% Si (25 μm) | Crystalline Fe-3% Si (50 μm) | Crystalline Fe-3% Si (175 μm) | Crystalline Fe-3% Si (275 μm) |
| 0.7 T | 6.94 | 13 | 9.0 | 18 | 24 |
| 0.9 T | 9.92 | 20 | 17 | 28 | 41 |
| 1.0 T | 11.51 | 24 | 20 | 31 | 46 |
| 1.1 T | 13.46 | | | | |
| 1.2 T | 15.77 | 33 | 28 | | |
| 1.3 T | 17.53 | | | | |
| 1.4 T | 19.67 | 44 | 35 | | |

TABLE 3

| | Core Loss @ 5,000 Hz (W/kg) | | | |
|---|---|---|---|---|
| | Material | | | |
| Flux Density | Amorphous $Fe_{80}B_{11}Si_9$ (22 μm) | Crystalline Fe-3% Si (25 μm) National-Arnold Magnetics Silectron | Crystalline Fe-3% Si (50 μm) National-Arnold Magnetics Silectron | Crystalline Fe-3% Si (175 μm) National-Arnold Magnetics Silectron |
| 0.04 T | 0.25 | 0.33 | 0.33 | 1.3 |
| 0.06 T | 0.52 | 0.83 | 0.80 | 2.5 |
| 0.08 T | 0.88 | 1.4 | 1.7 | 4.4 |
| 0.10 T | 1.35 | 2.2 | 2.1 | 6.6 |
| 0.20 T | 5 | 8.8 | 8.6 | 24 |
| 0.30 T | 10 | 18.7 | 18.7 | 48 |

TABLE 4

| | Core Loss @ 20,000 Hz (W/kg) | | | |
|---|---|---|---|---|
| | Material | | | |
| Flux Density | Amorphous $Fe_{80}B_{11}Si_9$ (22 μm) | Crystalline Fe-3% Si (25 μm) National-Arnold Magnetics Silectron | Crystalline Fe-3% Si (50 μm) National-Arnold Magnetics Silectron | Crystalline Fe-3% Si (175 μm) National-Arnold Magnetics Silectron |
| 0.04 T | 1.8 | 2.4 | 2.8 | 16 |
| 0.06 T | 3.7 | 5.5 | 7.0 | 33 |
| 0.08 T | 6.1 | 9.9 | 12 | 53 |
| 0.10 T | 9.2 | 15 | 20 | 88 |
| 0.20 T | 35 | 57 | 82 | |
| 0.30 T | 70 | 130 | | |

EXAMPLE 3

High Frequency Behavior of an Inductive Device Comprising Stamped Amorphous Metal Arcuate Components The core loss data of Example 2 above are analyzed using conventional non-linear regression methods. It is determined that the core loss of a low-loss bulk amorphous metal device comprised of components fabricated with $Fe_{80}B_{11}Si_9$ amorphous metal ribbon can be essentially defined by a function having the form $$L(B_{max}, f)=c_1 f(B_{max})^n+c_2 f^q(B_{max})^m$$

Suitable values of the coefficients $c_1$ and $c_2$ and the exponents n, m, and q are selected to define an upper bound to the magnetic losses of the bulk amorphous metal component. Table 5 recites the losses of the component in Example 2 and the losses predicted by the above formula, each measured in watts per kilogram. The predicted losses as a function of f (Hz) and $B_{max}$ (Tesla) are calculated using the coefficients $c_1$=0.0074 and $c_2$=0.000282 and the exponents n=1.3, m=2.4, and q=1.5. The loss of the bulk amorphous metal device of Example 2 is less than the corresponding loss predicted by the formula.

TABLE 5

| Point | $B_{max}$ (Tesla) | Frequency (Hz) | Measured Core Loss (W/kg) | Predicted Core Loss (W/kg) |
|---|---|---|---|---|
| 1 | 0.3 | 60 | 0.1 | 0.10 |
| 2 | 0.7 | 60 | 0.33 | 0.33 |
| 3 | 1.1 | 60 | 0.59 | 0.67 |
| 4 | 1.3 | 60 | 0.75 | 0.87 |
| 5 | 1.4 | 60 | 0.85 | 0.98 |
| 6 | 0.3 | 1000 | 1.92 | 2.04 |
| 7 | 0.5 | 1000 | 4.27 | 4.69 |
| 8 | 0.7 | 1000 | 6.94 | 8.44 |
| 9 | 0.9 | 1000 | 9.92 | 13.38 |
| 10 | 1 | 1000 | 11.51 | 16.32 |
| 11 | 1.1 | 1000 | 13.46 | 19.59 |
| 12 | 1.2 | 1000 | 15.77 | 23.19 |
| 13 | 1.3 | 1000 | 17.53 | 27.15 |
| 14 | 1.4 | 1000 | 19.67 | 31.46 |
| 15 | 0.04 | 5000 | 0.25 | 0.61 |
| 16 | 0.06 | 5000 | 0.52 | 1.07 |
| 17 | 0.08 | 5000 | 0.88 | 1.62 |
| 18 | 0.1 | 5000 | 1.35 | 2.25 |
| 19 | 0.2 | 5000 | 5 | 6.66 |
| 20 | 0.3 | 5000 | 10 | 13.28 |
| 21 | 0.04 | 20000 | 1.8 | 2.61 |
| 22 | 0.06 | 20000 | 3.7 | 4.75 |
| 23 | 0.08 | 20000 | 6.1 | 7.41 |
| 24 | 0.1 | 20000 | 9.2 | 10.59 |
| 25 | 0.2 | 20000 | 35 | 35.02 |
| 26 | 0.3 | 20000 | 70 | 75.29 |

EXAMPLE 4

Preparation of an Amorphous Metal Trapezoidal Prism and Inductor $Fe_{80}B_{11}Si_9$ ferromagnetic amorphous metal ribbon, approximately 25 mm wide and 0.022 mm thick, is cut by a photolithographic etching technique into trapezoidal laminations. The parallel sides of each trapezoid are formed by the edges of the ribbon and the remaining sides are formed at oppositely directed 45° angles. Approximately 1,300 layers of the cut ferromagnetic amorphous metal ribbon are stacked and registered to form each trapezoidal prismatic shape approximately 30 mm thick. Each shape is annealed at a temperature held at about 365° C. for about two hours and then is impregnated by immersion in a low viscosity epoxy resin and subsequently cured. Four such parts are formed with parallel long sides about 150 mm long and short sides about 100 mm long. The mitered mating faces formed by the angularly cut ends of each lamination are perpendicular to the plane of the ribbon layers in each prism and are approximately 35 mm wide and 30 mm thick, corresponding to the 1300 layers of ribbon. The mating faces are refined by a light grinding to remove excess epoxy and form a planar surface. The mating faces subsequently are etched in a nitric acid/water solution and cleaned in an ammonium hydroxide/water solution.

An electrical winding is wrapped around each of the four prisms, which are then assembled to form a transformer having square picture frame configuration with a square window. The respective windings on opposite components are connected in series aiding to form a primary and a secondary.

The core loss of the transformer is tested by driving the primary with a source of AC current and detecting the induced voltage in the secondary. The core loss of the transformer is determined using a Yokogawa Model 2532 conventional electronic wattmeter connected to the primary and secondary windings. With the core excited at a frequency of 5 kHz to a peak flux level of 0.3 T, a core loss of less than about 12 W/kg is observed.

EXAMPLE 5

Preparation of a Nanocrystalline Alloy Rectangular Prism

A rectangular prism is prepared using amorphous metal ribbon approximately 25 mm wide and 0.018 mm thick and having a nominal composition of $Fe_{73.5}Cu_1Nb_3B_9Si_{13.5}$. Approximately 1600 rectangularly shaped pieces of the strip 100 about mm long are cut by a photoetching process and stacked in registry in a fixture. The stack is heat treated to form a nanocrystalline microstructure in the amorphous metal. An anneal is carried out by performing the following steps: 1) heating the parts up to 580° C.; 2) holding the temperature at approximately 580° C. for approximately 1 hour; and 3) cooling the parts to ambient temperature. After heat treatment the stack is impregnated by immersion in a low viscosity epoxy resin. The resin is activated and cured at a temperature of about 177° C. for approximately 2.5 hours to form an epoxy impregnated, rectangular prismatic bulk magnetic component. The process is repeated to form three additional, substantially identical components. Two mating surfaces are prepared on each prism by a light grinding technique to form a flat surface. One of the faces is located on an end of each prism, while the other surface of substantially the same size is formed on the side of the prism at the distal end. Both mating surfaces are substantially perpendicular to the plane of each layer of the component.

The four prisms are then assembled and secured by banding to form an inductive device having a square, picture-frame configuration, of the form depicted by FIG. 10. A primary electrical winding is applied encircling one of the prisms and a secondary winding is applied to the prism opposite. The windings are connected to a standard electronic wattmeter. The core loss of the device is then tested by passing an electrical current through the primary winding and detecting the induced voltage in the secondary winding. Core loss is determined with a Yokogawa 2532 wattmeter.

The nanocrystalline alloy inductive device has a core loss of less about 12 W/kg at 5 kHz and 0.3 T, rendering it suitable for use in a high efficiency inductor or transformer.

Having thus described the invention in rather full detail, it will be understood that such detail need not be strictly adhered to but that various changes and modifications may suggest themselves to one skilled in the art, all falling within the scope of the present invention as defined by the subjoined claims.

What is claimed is:

1. An inductive device, comprising:

a. a magnetic core having a magnetic circuit with at least one air gap and including at least one low-loss bulk ferromagnetic amorphous metal magnetic component;

b. at least one electrical winding encircling at least a portion of said magnetic core;

c. said component comprising a plurality of substantially similarly shaped, planar layers of amorphous metal strips stacked, registered, and bonded together with an adhesive agent to form a polyhedrally shaped part; and d. said inductive device having a core-loss less than about 12 W/kg when operated at an excitation frequency "f" of 5 kHz to a peak induction level "$Bin_{max}$" of 0.3 T.

2. An inductive device as recited by claim 1, said device being a member selected from the group consisting of transformers, autotransformers, saturable reactors, and inductors.

3. An inductive device as recited by claim 1, wherein said magnetic core comprises a plurality of said low-loss bulk ferromagnetic amorphous metal magnetic components each having at least two mating faces, and said components are assembled in juxtaposed relationship so that each of said mating faces is proximate and substantially parallel to one of the mating faces of another of said components.

4. An inductive device as recited by claim 1, wherein said magnetic core has one low-loss bulk ferromagnetic amorphous metal magnetic component.

5. An inductive device as recited by claim 1, comprising a plurality of electrical windings.

6. An inductive device as recited by claim 1, further comprising a spacer in said air gap.

7. An inductive device as recited by claim 1, wherein said layer of amorphous metal are annealed.

8. An inductive device as recited by claim 1, said device having a core-loss less than "L" wherein L is given by the formula $L=0.0074\ f(B_{max})^{1.3}+0.00282\ f^{1.5}\ (B_{max})^{2.4}$, said core loss, said excitation frequency and said peak induction level being measured in watts per kilogram, hertz, and teslas, respectively.

9. An inductive device as recited by claim 1, wherein at least a portion of the surface of said magnetic core is coated with an insulative coating.

10. An inductive device as recited by claim 9, wherein said coating covers substantially the entire surface of said magnetic core.

11. An electronic circuit device comprising at least one low-loss inductive device selected from the group consisting of transformers, autotransformers, saturable reactors, and inductors, the device comprising:

a. a magnetic core comprising a plurality of low-loss bulk ferromagnetic amorphous metal magnetic components assembled in juxtaposed relationship and forming at least one magnetic circuit, each of said components comprising a plurality of substantially similarly shaped, planar layers of amorphous metal strips bonded together with an adhesive agent to form a polyhedrally shaped part having a thickness and a plurality of mating faces, the thickness of each of said components being substantially equal;

b. securing means for securing said components in said relationship wherein said components are disposed with said layers of said strips of each of said components in substantially parallel planes and with each of said mating faces proximate a mating face of another of said components; and c. at least one electrical winding encircling at least a portion of said magnetic core; and wherein said inductive device has a core loss less than about 12 W/kg when operated at an excitation frequency "f" of 5 kHz to a peak induction level "$B_{max.}$" of 0.3 T.

12. A power conditioning circuit device selected from the group consisting of switch mode power supplies and switch mode voltage converters, the device comprising:

a. a magnetic core comprising a plurality of low-loss bulk ferromagnetic amorphous metal magnetic components assembled in juxtaposed relationship and forming at least one magnetic circuit, each of said components comprising a plurality of substantially similarly shaped, planar layers of amorphous metal strips bonded together with an adhesive agent to form a polyhedrally shaped part having a thickness and a plurality of mating faces, the thickness of each of said components being substantially equal;

b. securing means for securing said components in said relationship wherein said components are disposed with said layers of said strips of each of said components in substantially parallel planes and with each of said mating faces proximate a mating face of another of said components; and c. at least one electrical winding encircling at least a portion of said magnetic core; and wherein said inductive device has a core loss less than about 12 W/kg when operated at an excitation frequency "f" of 5 kHz to a peak induction level "$B_{max.}$" of 0.3 T.

* * * * *

UNITED STATES PATENT AND TRADEMARK OFFICE

CERTIFICATE OF CORRECTION

PATENT NO. : 6,873,239 B2 
APPLICATION NO. : 10/286736
DATED : March 29, 2005
INVENTOR(S) : Nicholas J. Decristofaro et al.

It is certified that error appears in the above-identified patent and that said Letters Patent is hereby corrected as shown below:

Title Page, [56] FOREIGN PATENT DOCUMENTS
Change "58-148418 9/1993" to --58-148418 9/1983--.

Signed and Sealed this

Fifth Day of December, 2006

JON W. DUDAS
*Director of the United States Patent and Trademark Office*